US007777677B2

(12) United States Patent
Bungo et al.

(10) Patent No.: US 7,777,677 B2
(45) Date of Patent: Aug. 17, 2010

(54) ANTENNA DEVICE AND COMMUNICATION APPARATUS

(75) Inventors: Akihiro Bungo, Tokyo (JP); Takao Yokoshima, Tokyo (JP); Shinsuke Yukimoto, Kumagaya (JP); Toshiaki Edamatsu, Chichibu-gun (JP)

(73) Assignee: Mitsubishi Material Corporation, Tokyo (JP)

( * ) Notice: Subject to any disclaimer, the term of this patent is extended or adjusted under 35 U.S.C. 154(b) by 320 days.

(21) Appl. No.: 10/596,812

(22) PCT Filed: Dec. 24, 2004

(86) PCT No.: PCT/JP2004/019337

§ 371 (c)(1),
(2), (4) Date: Jul. 19, 2007

(87) PCT Pub. No.: WO2005/064743

PCT Pub. Date: Jul. 14, 2005

(65) Prior Publication Data

US 2007/0285335 A1 Dec. 13, 2007

(30) Foreign Application Priority Data

| | | |
|---|---|---|
| Dec. 25, 2003 | (JP) | 2003-430022 |
| Mar. 12, 2004 | (JP) | 2004-070875 |
| Mar. 12, 2004 | (JP) | 2004-071513 |
| Aug. 4, 2004 | (JP) | 2004-228157 |
| Aug. 31, 2004 | (JP) | 2004-252435 |
| Oct. 18, 2004 | (JP) | 2004-302924 |

(51) Int. Cl.
*H01Q 1/38* (2006.01)
*H01Q 1/36* (2006.01)

(52) U.S. Cl. ..... 343/700 MS; 343/895

(58) Field of Classification Search ..... None
See application file for complete search history.

(56) References Cited

U.S. PATENT DOCUMENTS

2001/0002823 A1 6/2001 Ying
2001/0043159 A1 11/2001 Masuda et al.

(Continued)

FOREIGN PATENT DOCUMENTS

EP 1178561 2/2002

(Continued)

OTHER PUBLICATIONS

International Search Report for PCT/JP2004/019337 mailed Apr. 12, 2005.

*Primary Examiner*—Trinh V Dinh
(74) *Attorney, Agent, or Firm*—Leason Ellis LLP.

(57) ABSTRACT

There is provided an antenna device including a substrate, an earth section which is disposed on a portion of the substrate, a feed point which is disposed on the substrate, a loading section disposed on the substrate and constructed with a line-shaped conductor pattern which is formed in a longitudinal direction of an elementary body made of a dielectric material, an inductor section which connects one end of the conductor pattern to the earth section, and a feed point which feeds a current to a connection point of the one end of the conductor pattern and the inductor section, wherein a longitudinal direction of the loading section is arranged to be parallel to an edge side of the earth section.

8 Claims, 28 Drawing Sheets

U.S. PATENT DOCUMENTS

| | | | | |
|---|---|---|---|---|
| 2002/0118075 | A1 | 8/2002 | Ohwada et al. | |
| 2003/0080904 | A1 | 5/2003 | Chen | |
| 2003/0169209 | A1 * | 9/2003 | Ohara et al. | 343/895 |

FOREIGN PATENT DOCUMENTS

| | | | |
|---|---|---|---|
| EP | 1202383 | | 5/2002 |
| EP | 1291968 | | 3/2003 |
| JP | 09-326632 | A | 12/1997 |
| JP | 10-41741 | A | 2/1998 |
| JP | 10-284919 | A | 10/1998 |
| JP | 11-27041 | A | 1/1999 |
| JP | 2000-68726 | A | 3/2000 |
| JP | 2000-278028 | A | 10/2000 |
| JP | 2001-326521 | A | 11/2001 |
| JP | 2001-522152 | A | 11/2001 |
| JP | 2001-352212 | A | 12/2001 |
| JP | 2002-204121 | A | 7/2002 |
| JP | 2002-271123 | A | 9/2002 |
| JP | 2002-319810 | A | 10/2002 |
| JP | 2002-319811 | A | 10/2002 |
| JP | 2003-46311 | A | 2/2003 |
| JP | 2003-142915 | A | 5/2003 |
| JP | 2003-273628 | A | 9/2003 |
| JP | 2004-194089 | A | 7/2004 |
| WO | WO-01/45204 | A1 | 6/2001 |

* cited by examiner (a)

(b)

(a)

(b)

(a)

(b)

(a)

(b)

ANTENNA DEVICE AND COMMUNICATION APPARATUS

CROSS-REFERENCE TO PRIOR APPLICATION

This is a U.S. National Phase Application under 35 U.S.C. §371 of International Patent Application No. PCT/JP2004/019337, filed Dec. 24, 2004, and claims the benefit of Japanese Patent Application Nos. 2003-430022, filed Dec. 25, 2003; 2004-070875, filed Mar. 12, 2004; 2004-071513, filed Mar. 12, 2004; 2004-228157, filed Aug. 4, 2004; 2004-252435, filed Aug. 31, 2004 and 2004-302924, filed Oct. 18, 2004, all of which are incorporated by reference herein. The International Application was published in Japanese on Jul. 14, 2005 as International Publication No. WO 2005/064743 under PCT Article 21 (2).

TECHNICAL FIELD

The present invention relates to an antenna device used for a mobile communication radio apparatus such as a mobile phone and a radio apparatus for specific low-power radio communication or weak radio communication and a communication apparatus including the antenna device.

BACKGROUND ART

In general, a monopole antenna where a wire element having a length of ¼ of an antenna operating wavelength is disposed on a base plate is used as a line-shaped antenna. In addition, in order to obtain the monopole antenna having a small size and a low profile, an inverted L-shaped antenna has been developed by folding and bending a middle portion of the monopole antenna.

However, in the inverted L-shaped antenna, since a reactance section defined by a length of a horizontal portion of the antenna element parallel to the base plate has a large capacitive value, it is difficult to obtain matching at a feed line of 50Ω. Therefore, in order to facilitate the matching between the antenna element and the feed line having 50Ω, there is proposed an inverted F-shaped antenna. The inverted F-shaped antenna includes a stub for connecting the base plate to a radiation element in the vicinity of the feed point disposed at a middle portion of the antenna element. By doing so, the capacitive value caused from the reactance section, it is possible to easily obtain matching to the feed line having 50Ω (see, for example, "*Illustrated Antenna System*", by Hujimoto Kyohei, October 1996, p. 118-119, Sougou Denshi Publishing Company).

In addition, for example, in a communication apparatus such as a mobile phone, a communication control circuit is disposed in an inner portion of a case, and an antenna device is disposed in an inner portion of an antenna receiving portion provided to protrude from the case.

However, recently, a mobile phone coping with multi-band has been provided, so that a characteristic for multiple frequencies is required for a built-in antenna device used for the mobile phone. As a general provided one, there are a dual band mobile phone for GSM (Global System for Mobile Communication) using a band of 900 MHz and DCS (Digital Cellular System) using 1.8 GHz in Europe and a dual band mobile phone for AMPS (Advanced Mobile Phone Service) using a band of 800 MHz and PCS (Personal Communication Services) using a band of 1.9 GHz band. As a built-in antenna device used for the mobile phone coping with the dual bands, antennas manufactured by modifying a planar inverted F-shaped antenna or an inverted F-shaped antenna are widely used.

Conventionally, as such an antenna device, there is proposed an antenna device constructed by forming a slit in a radiation plate on a plate of a planar inverted F-shaped antenna and dividing the radiation plate into first and second radiation plates, thereby performing resonance with a frequency corresponding to a wavelength which is about ¼ of path lengths (see, for example, Japanese Unexamined Patent Application Publication No. 10-93332 (FIG. 2)).

In addition, there is proposed an antenna device constructed by disposing an non-excitation electrode in the vicinity of an inverted F-shaped antenna disposed on a conductor plane and generating even and odd modes, thereby performing resonance with a frequency corresponding to a wavelength which is about ¼ of lengths of radiation conductors (see, for example, Japanese Unexamined Patent Application publication No. 9-326632 (FIG. 2)).

In addition, there is proposed an antenna device using line-shaped first inverted L-shaped antenna element and second inverted L-shaped antenna element, thereby performing resonance with two different frequencies (see, for example, Japanese Unexamined Patent Application publication No. 2002-185238 (FIG. 2)). In the antenna device, a length of a radiation conductor needs to be about ⅛ to ⅜ with respect to the resonance frequency.

In addition, in an antenna device, there is the following Formula 1 as a relation between a size of an antenna element and antenna characteristics (see "*New Antenna Engineering*", by Hiroyuki, September 1996, p. 108-109, Sougou Denshi Publishing Company).

$$(\text{Electrical Volume of Antenna})/(\text{Band})\times(\text{Gain})\times(\text{Efficiency})=\text{Constant Value} \quad \text{(Formula 1)}$$

In Formula 1, the constant value is a value defined according to a type of an antenna.

SUMMARY OF THE INVENTION

However, in a conventional inverted F-shaped antenna, since a length of a horizontal portion of the antenna element parallel to the base plate needs to be about ¼ of the antenna operating wavelength, there is a need for lengths of 170 mm and 240 mm for a specific low-power radio communication having a band of 430 MHz and a weak radio communication using a frequency of about 315 MHz, respectively. For the reason, it is difficult to apply a built-in antenna device to a practical radio apparatus in a relatively low frequency such as a band of 400 MHz.

In addition, when a conventional antenna device is applied to a low frequency band such as 800 MHz, there is a problem in that a size of the antenna device greatly increases. For example, in an application to a low frequency band such as 800 MHz, there is a problem in that a size of the antenna device greatly increases.

In addition, Formula 1 represents that, when an antenna device having the same shape is miniaturized, a band of the antenna device is reduced, so that the radiation efficiency is reduce. Therefore, for example, since a mobile phone having a band of 800 MHz utilizes an FDD (Frequency Division Duplex) scheme using different frequency bands for transmission and reception in Japan, it is difficult to implement a compact built-in antenna capable of covering transmission and reception bands.

In addition, in the conventional antenna device, since two loading elements are disposed in a straight line shape, when the antenna device is received in an antenna receiving portion, it protrudes into an inner portion of a case, so that an arrangement of a communication control circuit is limited. Therefore, there is a problem in that a space factor is deteriorated.

The present invention is contrived in order to solve the problems, and an object of the present invention is to provide an antenna device which can be miniaturized even in a relatively low frequency band such as 400 MHz band.

In addition, an object of the present invention is to provide a compact antenna device having two resonance frequencies.

In addition, an object of the present invention is to provide a communication apparatus including a compact antenna device having two resonance frequencies and having a good space factor.

In order to solve the aforementioned problems, the present invention employs the following constructions. According to an aspect of the invention, there is provided an antenna device having: a substrate; a conductor film which is disposed on a portion of the substrate; a feed point disposed on the substrate; a loading section disposed on the substrate and constructed with a line-shaped conductor pattern which is formed in a longitudinal direction of a body made of a dielectric material; an inductor section which connects one end of the conductor pattern to the conducive film; and a feed point which feeds a current to a connection point of the one end of the conductor pattern and the inductor section, wherein a longitudinal direction of the loading section is arranged to be parallel to an edge side of the conductor film.

According to the antenna device of the present invention, although a physical length of an antenna element parallel to the conductor film is shorter than ¼ of an antenna operating wavelength, an electrical length can be ¼ of the antenna operating wavelength due to a combination of the loading section and the inductor section. Therefore, in terms of the physical length, the antenna device can be miniaturized greatly, so that even in a relatively low frequency band such as 400 MHz band, the present invention can be applied to a built-in antenna device for a practical radio apparatus.

In addition, it is preferable that, in the antenna device of the present invention, a capacitor section is connected between the connection point and the feed point.

According to the antenna device of the present invention, since the capacitor section which connects the feed point to the one end of the conductor pattern is provided and a capacitance of the capacitor section is set to a predetermined value, it is possible to easily match an impedance of the antenna device at the feed point.

In addition, it is preferable that, in the antenna device of the present invention, the loading section includes a lumped element circuit.

According to the antenna device of the present invention, the electrical length is adjusted by the lumped element circuit formed the loading section. Therefore, it is possible to easily set a resonance frequency without changing a length of the conductor pattern of the loading section. In addition, it is possible to match an impedance of the antenna device at the feed point.

In addition, it is preferable that, in the antenna device of the present invention, a line-shaped meander pattern is connected to the other end of the conductor pattern.

According to the antenna device of the present invention, since the line-shaped meander pattern is connected to the conductor pattern, it is possible to obtain an antenna section having a wide band or a high gain.

In addition, it is preferable that, in the antenna device of the present invention, the capacitor section includes a capacitor section which is constructed with a pair of planar electrodes formed on the body to face each other.

According to the antenna device of the present invention, since a pair of planar electrodes facing each other are formed in the body, the loading section and the capacitor section can be formed in a body. Therefore, it is possible to reduce the number of parts of the antenna device.

In addition, it is preferable that, in the antenna device of the present invention, one of a pair of the planar electrodes is disposed on a surface of the body and can be trimmed.

According to the antenna device of the present invention, since one of planar electrode formed on a surface of the body among a pair of the planar electrodes constituting the capacitor section is trimmed by, for example, laser beam, it is possible to adjust the capacitance of the capacitor section. Therefore, it is possible to easily match an impedance of the antenna device at the feed point.

In addition, it is preferable that, in the antenna device of the present invention, a multiple-resonance capacitor section is equivalently serially connected between two different points of the conductor pattern.

According to the antenna device of the present invention, a resonance circuit is formed with the conductor pattern between the two points and the multiple-resonance capacitor section serially connected thereto. Therefore, it is possible to obtain a compact antenna device having multiple resonance frequencies.

In addition, it is preferable that, in the antenna device of the present invention, the conductor pattern is wound around the body in a longitudinal direction thereof in a helical shape.

According to the antenna device of the present invention, since the conductor pattern is formed in a helical shape, it is possible to increase a length of the conductor pattern, so that it is possible to increase a gain of the antenna device.

In addition, it is preferable that, in the antenna device of the present invention, the conductor pattern is formed on a surface of the body in a meander shape.

According to the antenna device of the present invention, since the conductor pattern is formed in a meander shape, it is possible to increase a length of the conductor pattern, so that it is possible to increase a gain of the antenna device. In addition, since the conductor pattern is formed on a surface of the body, it is possible to easily form the conductor pattern.

In order to solve the aforementioned problems, the present invention employs the following constructions. According to another aspect of the invention, there is provided an antenna device comprising: a substrate; a conductor film which is formed to extend in one direction on a surface of the substrate; first and second loading sections which are disposed to be separated from the conductor film on the substrate and constructed by forming a line-shaped conductor pattern on a body made of a dielectric material, a magnetic material, or a complex material having dielectric and magnetic properties; an inductor section which is connected between one end of the conductor pattern and the conductor film; and a feed section which feeds a current to a connection point of the one end of the conductor pattern and the inductor section, wherein a first resonance frequency is set by the first loading section, the inductor section, and the feed section, and a second resonance frequency is set by the second loading section, the inductor section, and the feed section.

According to the antenna device of the present invention, the first antenna section having the first resonance frequency is constructed with the first loading section, the inductor section, and the feed section, and the second antenna section having the second resonance frequency is constructed with the second loading section, the inductor section, and the feed section. In the first and second antenna sections, although a physical length of an antenna element is shorter than ¼ of an antenna operating wavelength, it is satisfied that an electrical length becomes ¼ of the antenna operating wavelength due to a combination of the loading section and the inductor section. Therefore, in case of an antenna device having two resonance frequencies, the antenna device can be miniaturized greatly.

In addition, electrical lengths of the first and second antenna sections are adjusted by adjusting the inductance of the inductor section. Therefore, it is possible to easily set the first and second resonance frequencies.

In addition, it is preferable that, in the antenna device of the present invention, any one or both of the first and second loading sections includes a lumped element circuit.

According to the antenna device of the present invention, since the electrical length is adjusted by the lumped element circuit provided to the loading section, it is possible to easily set a resonance frequency without changing a length of the conductor pattern of the loading section.

In addition, it is preferable that, in the antenna device of the present invention, a line-shaped meander pattern is connected to the other end of the conductor pattern.

According to the antenna device of the present invention, since the line-shaped meander pattern is connected to the conductor pattern, it is possible to obtain an antenna section having a wide band or a high gain.

In addition, it is preferable that, in the antenna device of the present invention, an extension member is connected to the other end of the conductor pattern.

According to the antenna device of the present invention, since the extension member is disposed, it is possible to obtain an antenna section having a wider band and a higher gain.

In addition, it is preferable that, in the antenna device of the present invention, an extension member is connected to a front end of the meander pattern.

According to the antenna device of the present invention, it is possible to obtain an antenna device having a wider band and a higher gain than the antenna section similar to the aforementioned antenna device.

In addition, it is preferable that, in the antenna device of the present invention, an impedance adjusting section is connected between the connection point and the feed section.

According to the antenna device of the present invention, it is possible to easily adjust impedance at the feed section by using the impedance adjusting section.

In addition, it is preferable that, in the antenna device of the present invention, the conductor pattern is wound around the body in a longitudinal direction thereof in a helical shape.

According to the antenna device of the present invention, since the conductor pattern is formed in a helical shape, it is possible to increase a length of the conductor pattern, so that it is possible to increase a gain of the antenna device.

In addition, it is preferable that, in the antenna device of the present invention, the conductor pattern is formed on a surface of the body in a meander shape.

According to the antenna device of the present invention, since the conductor pattern is formed in a meander shape, it is possible to increase a length of the conductor pattern, so that it is possible to increase a gain of the antenna device.

In addition, since the conductor pattern is formed on a surface of the body, it is possible to easily form the conductor pattern.

In order to solve the aforementioned problems, the present invention employs the following constructions. According to still another aspect of the invention, there is provided a communication apparatus having: a case; and a communication control circuit which is disposed in an inner portion of the case; and an antenna device which is connected to the communication control circuit, wherein the case includes a case body and an antenna receiving portion which is disposed to extend from one side wall of the case body outward, wherein the antenna device includes: a substantially L-shaped substrate which has a first substrate portion extending in one direction and a second substrate portion curved from the first substrate portion and extending toward a lateral direction of the first substrate portion; a ground connection portion which is disposed on the substrate and connected to a ground of the communication control circuit; a first loading section which is disposed on the first substrate portion and constructed by forming a line-shaped conductor pattern on a body made of a dielectric material, a magnetic material, or a complex material having dielectric and magnetic properties; a second loading section which is disposed on the second substrate portion and constructed by forming a line-shaped conductor pattern on a body made of a dielectric material, a magnetic material, or a complex material having dielectric and magnetic properties; an inductor section which connects ends of the first and second loading sections to the ground connection portion; and a feed section which is connected to the communication control circuit and feeds a current to a connection point of the ends of the first and second loading section and the inductor section, and wherein any one of the first substrate portion provided with the first loading section and the second substrate portion provided with the second loading section are disposed in the antenna receiving portion, and the other is disposed along an inner surface of the one side wall.

According to the present invention, the first antenna section having the first resonance frequency is constructed with the first loading section, the inductor section, and the feed section, and the second antenna section having the second resonance frequency is constructed with the second loading section, the inductor section, and the feed section. Here, although a physical length of an antenna element is shorter than ¼ of an antenna operating wavelength, it is satisfied that an electrical length becomes ¼ of the antenna operating wavelength due to a combination of the loading section and the inductor section. Therefore, the antenna device can be miniaturized greatly.

In addition, since the one of two loading sections is received in an antenna receiving portion and the other is disposed along an inner surface side of one side wall of a case body, a space factor becomes better without limitation to an arrangement position of a communication control circuit.

In addition, since the loading section disposed in the inner portion of the antenna receiving portion is disposed to protrude toward the outside of the case, it is possible to improve transmission and reception characteristics of the antenna section having the loading section.

In addition, it is preferable that, in the communication apparatus of the present invention, the antenna device includes a lumped element circuit provided to any one or both of the first and second loading sections.

According to the present invention, due to the lumped element circuit formed to the loading section, is possible to easily set a resonance frequency by adjusting the electrical length without changing a length of the conductor pattern of the loading section. In addition, it is possible to match an impedance of the antenna device at the feed point.

In addition, it is preferable that, in the communication apparatus of the present invention, the antenna device includes an impedance adjusting section which is connected between the connection point and the feed section.

According to the present invention, it is possible to match an impedance at the feed point by using the impedance adjusting section. Therefore, it is possible to efficiently perform signal transmission without providing a separate matching circuit for matching impedances between the antenna device and the communication control circuit.

In addition, it is preferable that, in the communication apparatus of the present invention, the conductor pattern is wound around the body in a longitudinal direction thereof in a helical shape.

According to the present invention, since the conductor pattern is formed in a helical shape, it is possible to increase a length of the conductor pattern, so that it is possible to increase a gain of the antenna device.

In addition, it is preferable that, in the communication apparatus of the present invention, the conductor pattern is formed on a surface of the body in a meander shape.

According to the present invention, since the conductor pattern is formed in a meander shape, it is possible to increase a length of the conductor pattern, so that it is possible to increase a gain of the antenna device similar to the aforementioned invention. In addition, since the conductor pattern is formed on a surface of the body, it is possible to easily form the conductor pattern.

DETAILED DESCRIPTION OF THE INVENTION

Hereinafter, an antenna device according to a first embodiment of the present invention will be described with reference to FIGS. 1 and 2.

The antenna device 1 according to the embodiment is an antenna device used for a mobile communication radio apparatus such as a mobile phone and a radio apparatus for specific low-power radio communication or weak radio communication.

Figure 1:
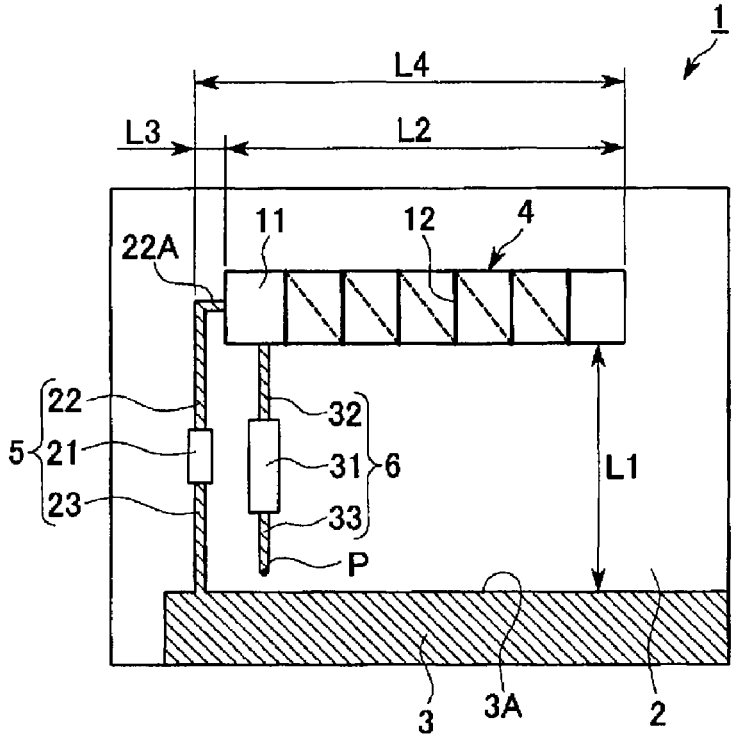
FIG. 1 is a plan view showing an antenna device according to a first embodiment of the present invention.
Figure 2:
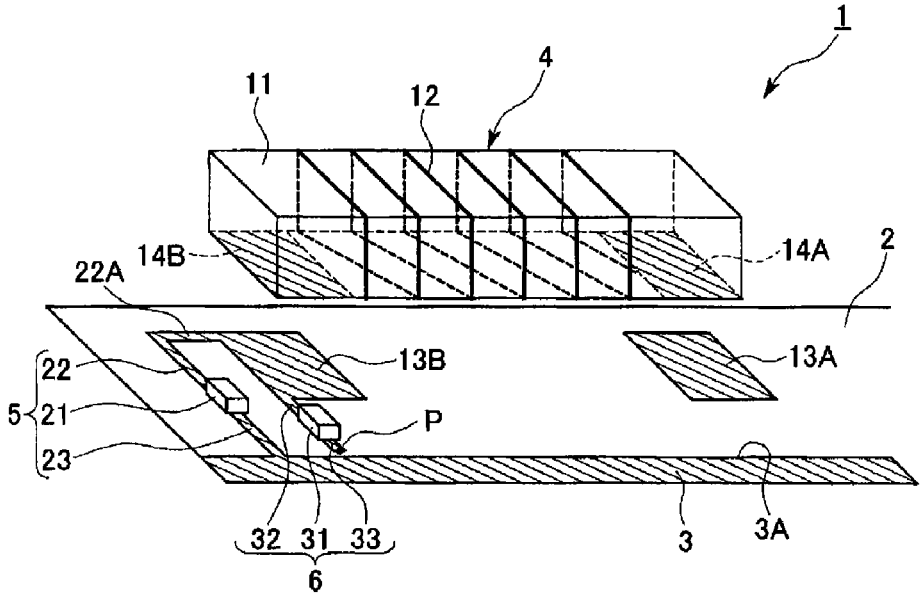
FIG. 2 is a perspective view showing the antenna device according to the first embodiment of the present invention.

As shown in FIGS. 1 and 2, the antenna device 1 includes a substrate 2 which is made of an insulating material such as a resin, an earth section 3 which is a rectangular conductor film disposed on a surface of the substrate 2, a loading section 4 which is disposed on one-side surface of the substrate 2, an inductor section 5, a capacitor section 6, and a feed point P which is disposed at an outer portion of the antenna device 1 to be connected to a radio frequency circuit (not shown). In addition, the antenna operating frequency is adjusted by the loading section 4 and the inductor section 5, so that waves are arranged to be radiated with a central frequency of 430 MHz.

The loading section 4 is constructed by forming a conductor pattern 12 in a helical shape in a longitudinal direction on a surface of a rectangular parallelepiped body 11 made of a dielectric material such as alumina.

Both ends of the conductor pattern 12 are electrically connected to connection electrodes 14A an 14B disposed on a rear surface of the body 11, respectively, so as to be electrically connected to rectangular setting conductors 13A and 13B disposed on the surface of the substrate 2. In addition, one end of the conductor pattern 12 is electrically connected through the setting conductor 13B to the inductor section 5 and the capacitor section 6, and the other end thereof is formed as an open end.

The loading section 4 is disposed to be separated from an edge side 3A of the earth section 3 by a distance L1 of, for example, 10 mm, and a length L2 of the loading section 4 in the longitudinal direction is arranged to 16 mm, for example.

In addition, since a physical length of the loading section 4 is shorter than ¼ of an antenna operating wavelength, a self resonance frequency of the loading section 4 is higher than the antenna operating frequency of 430 MHz. Therefore, in terms of the antenna operating frequency, the antenna device 1 is not considered to perform self resonance, so that a property thereof is different from that of a helical antenna which performs the self resonance with the antenna operating frequency.

The inductor section 5 includes a chip inductor 21 and is constructed to be connected to the setting conductor 13B through an L-shaped pattern 22 which is a line-shaped conductive pattern disposed on the surface of the substrate 2 and to the earth section 3 through the earth section connection pattern 23 which is a line-shaped conductive pattern disposed on the surface of the substrate 2.

An inductance of the chip inductor 21 is adjusted so that a resonance frequency due to the loading section 4 and the inductor section 5 becomes 430 MHz, that is, the antenna operating frequency of the antenna device 1.

In addition, the L-shaped pattern 22 is formed to have an edge side 22A parallel to the earth section 3 and a length L3 of 2.5 mm. Therefore, a physical length L4 of an antenna element parallel to the edge side 3A of the earth section 3 becomes 18.5 mm.

The capacitor section 6 includes a chip capacitor 31 and is constructed to be connected to the setting conductor 13B through a setting conductor connection pattern 32 which is a line-shaped conductive pattern disposed on the surface of the substrate 2 and to the feed point P through the feed point connection pattern 33 which is a line-shaped conductive pattern disposed on the surface of the substrate 2.

A capacitance of the chip capacitor 31 is adjusted so as to be matched with the impedance at the feed point P.

Figure 3:
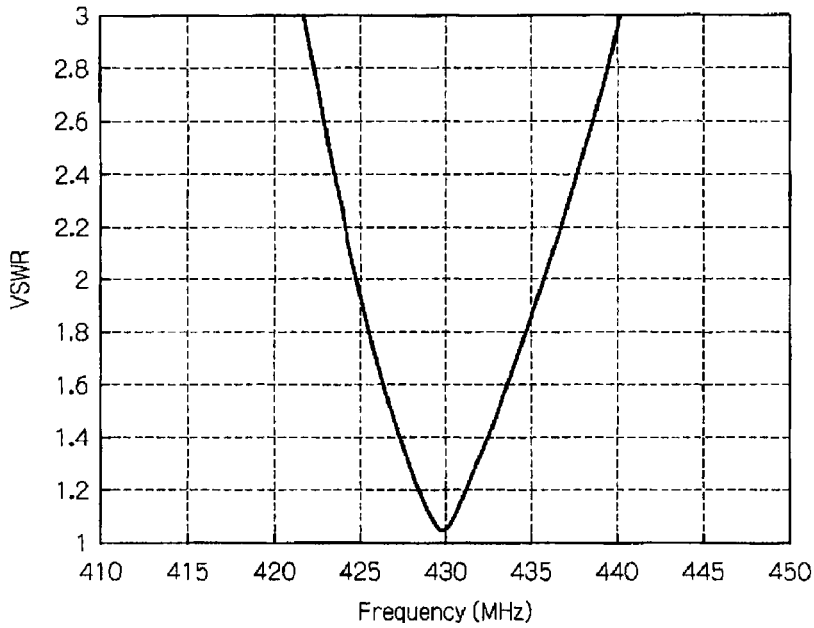
FIG. 3 is a graph showing a frequency characteristic of the antenna device according to the first embodiment of the present invention.
Figure 4:
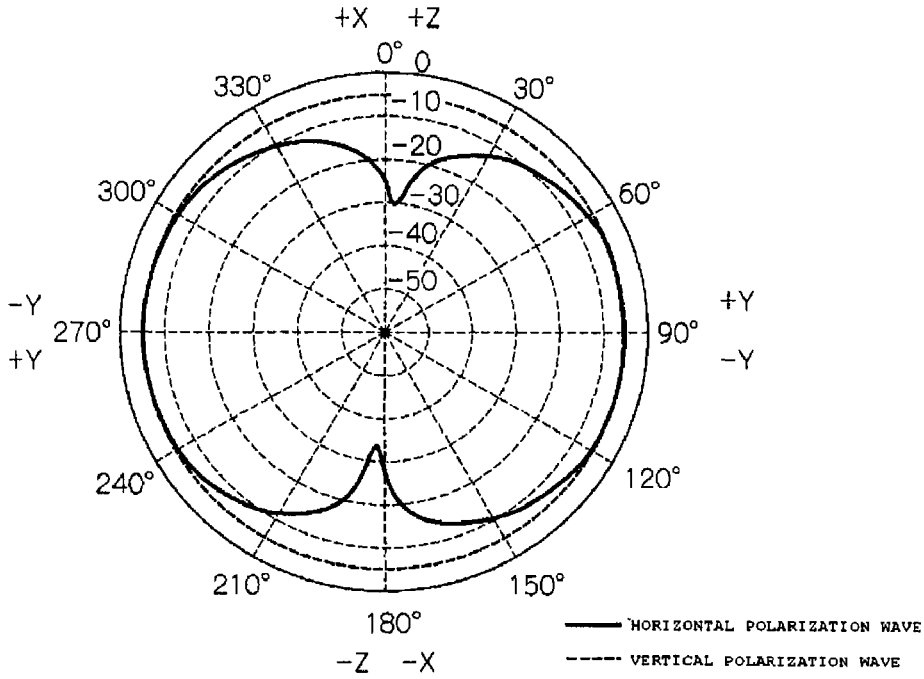
FIG. 4 is a graph showing a radiation pattern of the antenna device according to the first embodiment of the present invention.

A frequency characteristic of a VSWR (Voltage Standing Wave Ratio) of the antenna device 1 at a frequency of from 400 to 450 MHz and a radiation pattern of horizontal and vertical polarization waves are shown in FIGS. 3 and 4, respectively.

As shown in FIG. 3, the antenna device 1 has the VSWR of 1.05 at a frequency of 430 Hz and a bandwidth of 14.90 MHz at the VSWR of 2.5.

Next, transmission and reception of waves in the antenna device 1 according to the embodiment is described. In the antenna device 1 having such a construction, a high frequency signal having the antenna operating frequency transmitted from a radio frequency circuit to the feed point P is transmitted from the conductor pattern 12 as a wave. A wave having a frequency equal to the antenna operating frequency is received by the conductor pattern 12 and transmitted from the feed point P to the radio frequency circuit as a high frequency signal.

At this time, due to the capacitor section 6 having a capacitance capable of matching an input impedance of the antenna device 1 to the impedance at the feed point P, the transmission and reception of waves can be performed in a state that a power loss is reduced.

In the antenna device 1 having such a construction, although the physical length of the antenna element parallel to the edge side 3A of the earth section 3 is 18.5 mm, the electrical length becomes ¼ of a wavelength due to a combination of the loading section 4 and the inductor section 5, so that the antenna device can be miniaturized greatly to have a size of about 1/10 of the ¼ wavelength of the 430 MHz electromagnetic wave, that is, 170 mm.

By doing so, even in a relatively low frequency band such as 400 MHz band, the present invention can be applied to a built-in antenna device for a practical radio apparatus.

In addition, since the conductor pattern 12 is wound a helical shape in the longitudinal direction of the body 11, the conductor pattern 12 can become long, so that it is possible to improve a gain of the antenna device 1.

In addition, since impedance matching at the feed point P is formed by the capacitor section 6, there is no need to provide a matching circuit between the feed point P and the radio frequency circuit, so that it is possible to suppress deterioration in radiation gain caused from the matching circuit and efficiently perform transmission and reception of wave.

Figure 5:
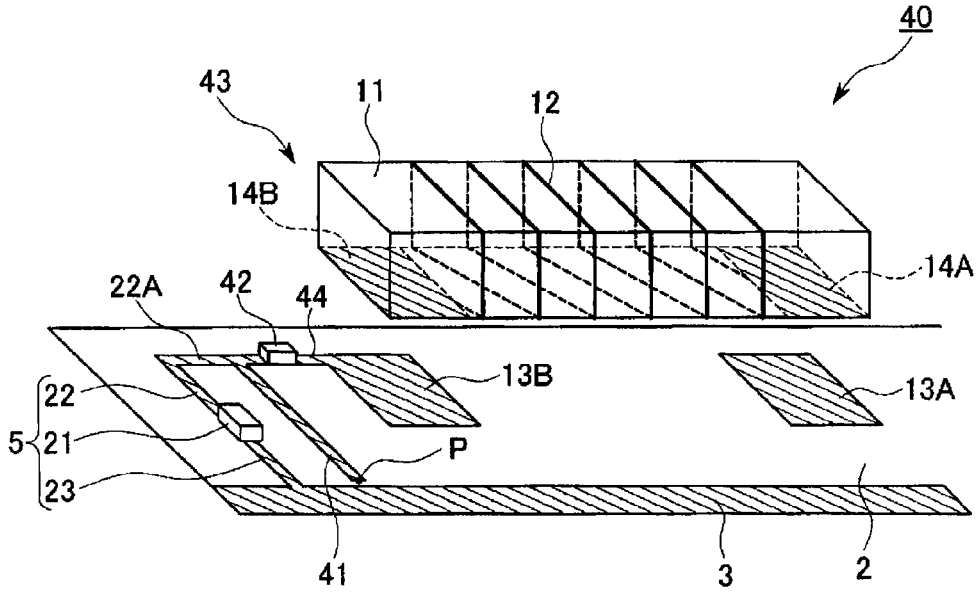
FIG. 5 is a perspective view showing an antenna device according to a second embodiment of the present invention.

Next, a second embodiment is described with reference to FIG. 5. In addition, the later description, the components described in the aforementioned embodiment are denoted by the same reference numerals, and description thereof is omitted.

A difference between the first and second embodiments is as follows. In the antenna device 1 according to the first embodiment, a connection to the feed point P is formed by using the capacitor section 6. However, in an antenna device 40 according to the second embodiment, the connection to the feed point P is formed by using a feed point connection pattern 41, and a chip inductor 42 is provided as a lumped element circuit between the setting conductor 13B and the inductor section 5.

Namely, the antenna device 40 includes a loading section 43, a setting conductor 13B, a feed point connection pattern 41 which connects a connection point of the loading section 43 and an inductor section 5 to a feed point P, a connection conductor 44 which connects a conductor pattern 13 to the inductor section 5, and a chip inductor 42 provided to the connection conductor 44.

Similar to the aforementioned first embodiment, in the antenna device 40 having such a construction, the physical length thereof can be greatly reduced by a combination of the loading section 43 and the inductor section 5.

In addition, since an electrical length of the loading section 43 can be adjusted by the chip inductor 42, it is possible to easily set a resonance frequency without adjusting a length of the conductor pattern 12.

In addition, since impedance matching at the feed point P is formed, it is possible to suppress deterioration in radiation gain caused from a matching circuit and efficiently perform transmission and reception of wave.

In addition, in the embodiment, as a lumped element circuit, the inductor is used, but the present invention is not limited thereto. The capacitor may be used, or a parallel or serial connection of the inductor and the capacitor may be used.

Figure 6:
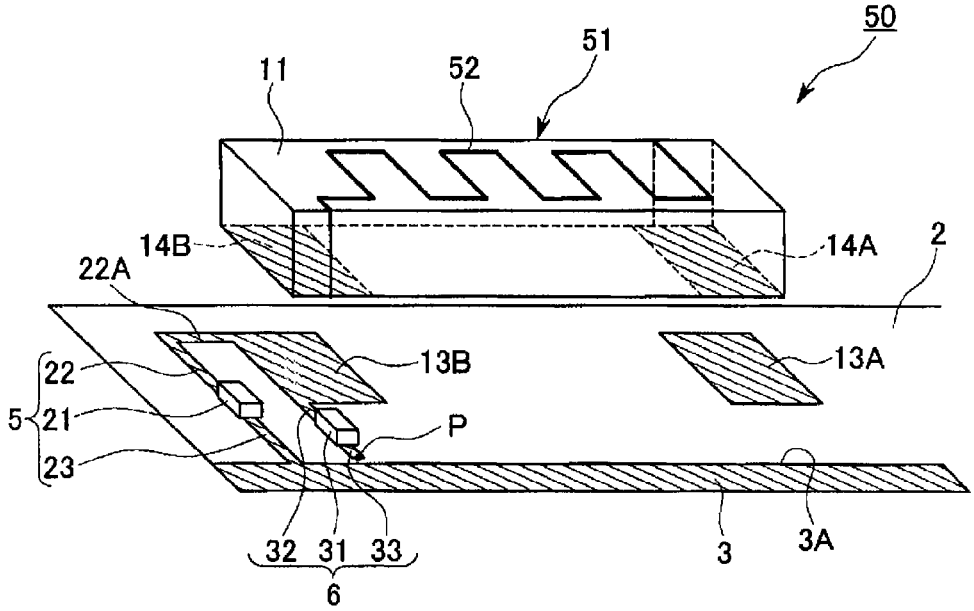
FIG. 6 is a perspective view showing an antenna device according to a third embodiment of the present invention.

Next, a third embodiment is described with reference to FIG. 6. In addition, the later description, the components described in the aforementioned embodiment are denoted by the same reference numerals, and description thereof is omitted.

A difference between the first and third embodiments is as follows. In the antenna device 1 according to the first embodiment, the conductor pattern 12 of the loading section 4 is wound in a helical shape around the body 11 in the longitudinal direction thereof. However, in an antenna device 50 according to the third embodiment, the conductor pattern 12 of the loading section 4 is formed in a meander shape on a surface of the body 11.

Namely, the conductor pattern 52 having a meander shape is formed on the surface of the body 11, and both ends of the conductor pattern 52 are connected to connection electrodes 14A and 14B, respectively.

In the antenna device 50 having such a construction, it is possible to obtain the same functions and effects as those of the antenna device 1 according to the first embodiment, and since the loading section 51 having a meander shape is constructed by forming a conductor on the surface of the body 11, it is possible to easily manufacture the loading section 51.

Figure 7:
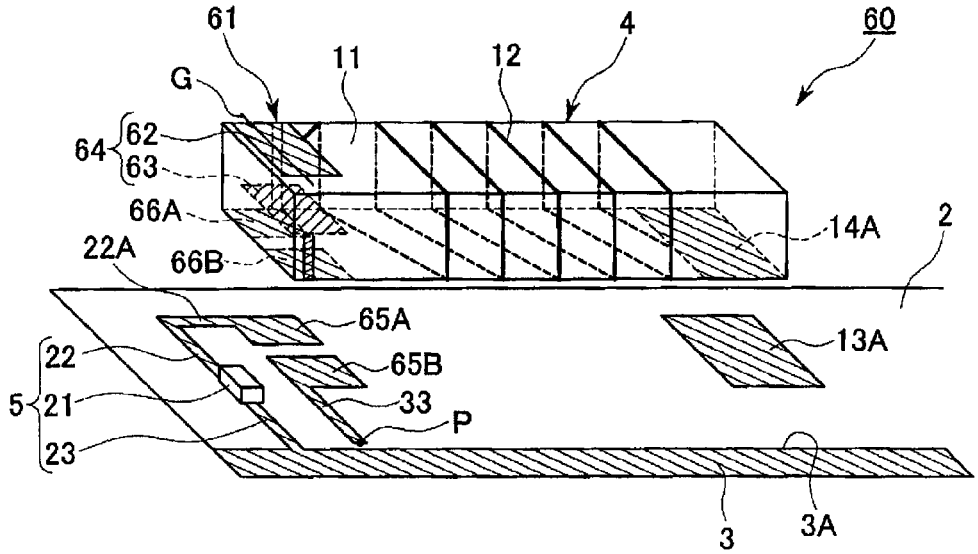
FIG. 7 is a perspective view showing an antenna device according to a fourth embodiment of the present invention.

Next, a fourth embodiment is described with reference to FIG. 7. In addition, the later description, the components described in the aforementioned embodiment are denoted by the same reference numerals, and description thereof is omitted.

A difference between the first and fourth embodiments is as follows. In the antenna device 1 according to the first embodiment, the capacitor section 6 has the chip capacitor 31, and impedance matching of the antenna device 1 at the feed point P is formed by using the chip capacitor 31. However, in an antenna device 60 according to the fourth embodiment, a capacitor section 61 has a pair of planar electrodes, that is, first and second planar electrodes 62 and 63 which are formed in a body 11 to face each other, and the impedance matching of the antenna device 60 at a feed point P is formed by using the capacitor section 64.

Namely, a conductor pattern 12 is formed in a helical shape on a surface of the body 12, and the first planar electrode 62 which is formed on the surface of the body 11 to be electrically connected to one end of the conductor pattern 12 and the second planar electrode 63 which is disposed in an inner portion of the body 11 to be face the first planar electrode 62 are formed.

The first planar electrode 62 can be arranged to be trimmed by forming a gap G, for example, by laser beam, so that it is possible to change a capacitance of the capacitor section 64.

In addition, the first planar electrode 62 is connected to a connection electrode 66A disposed on a rear surface of the body 11 so as to be electrically connected to rectangular setting conductors 13A, 65A, and 65B disposed on the surface of the substrate 2.

In addition, similar to the first planar electrode 62, the second planar electrode 63 is connected to a connection electrode 66B disposed on the rear surface of the body 11 so as to be electrically connected to the setting conductor 65B. The setting conductor 65B is electrically connected through the feed point connection pattern 33 to the feed point P.

The inductor section 67 is connected to the setting conductor 65B though an L-shaped pattern 22 which is a line-shaped conductive pattern where a chip inductor 21 is disposed on the surface of the substrate 2.

In the antenna device 60 having such a construction, it is possible to obtain the same functions and effects as those of the antenna device 1 according to the first embodiment, and since the first and second planar electrodes 62 and 63 facing each other are formed in the body 11, the loading section 4 and the capacitor section 64 can be formed in a body. Therefore, it is possible to reduce the number of parts of the antenna device 60.

In addition, since first planar electrode 62 can be trimmed by the laser beam, the capacitance of the capacitor section 64 can be changed, so that it is possible to easily match an impedance at the feed point P.

Figure 8:
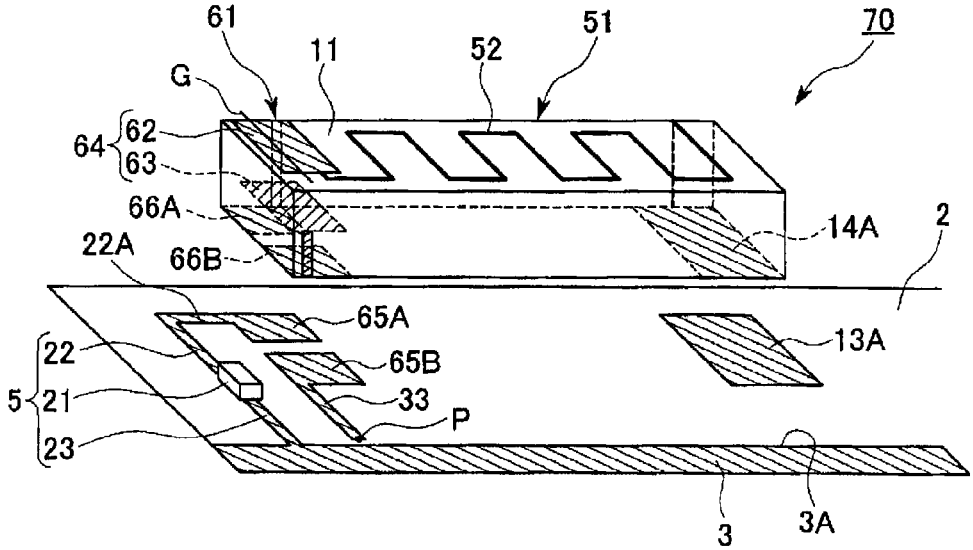
FIG. 8 is a perspective view showing an example of the antenna device according to the fourth embodiment of the present invention.

In addition, although the conductor pattern 12 has a helical shape formed by winding around the body 11 in the longitudinal direction thereof in the antenna device 60 according to the aforementioned fourth embodiment, an antenna device 70 may be formed to have an conductor pattern 52 having a meander shape as shown in FIG. 8 similar to the third embodiment.

Figure 9:
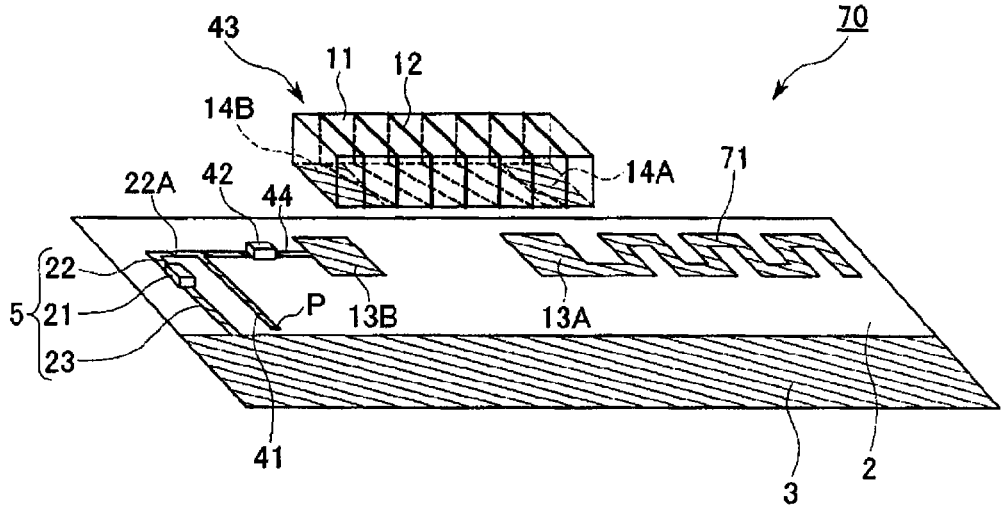
FIG. 9 is a perspective view showing an example of an antenna device according to a fifth embodiment of the present invention.

Namely, as shown in FIG. 9, a meander pattern 71 is formed in a meander shape and connected to a setting conductor 13A of the loading section 4 on the surface of the substrate 2. The meander pattern 71 is disposed so that a long axis thereof is parallel to the conductor film 3.

Figure 10:
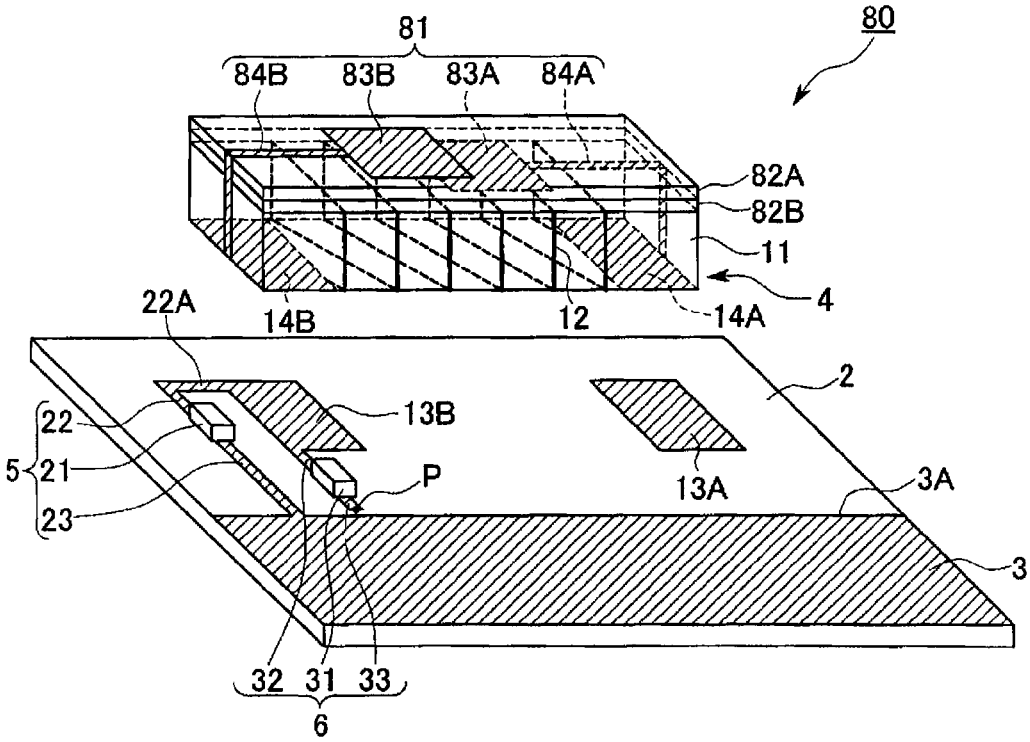
FIG. 10 is a perspective view showing an antenna device according to a sixth embodiment of the present invention.
Figure 11:
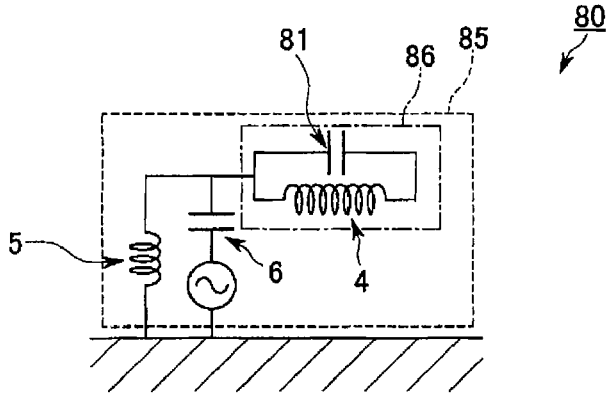
FIG. 11 is an equivalent circuit view showing the antenna device according to the sixth embodiment of the present invention.
Figure 12:
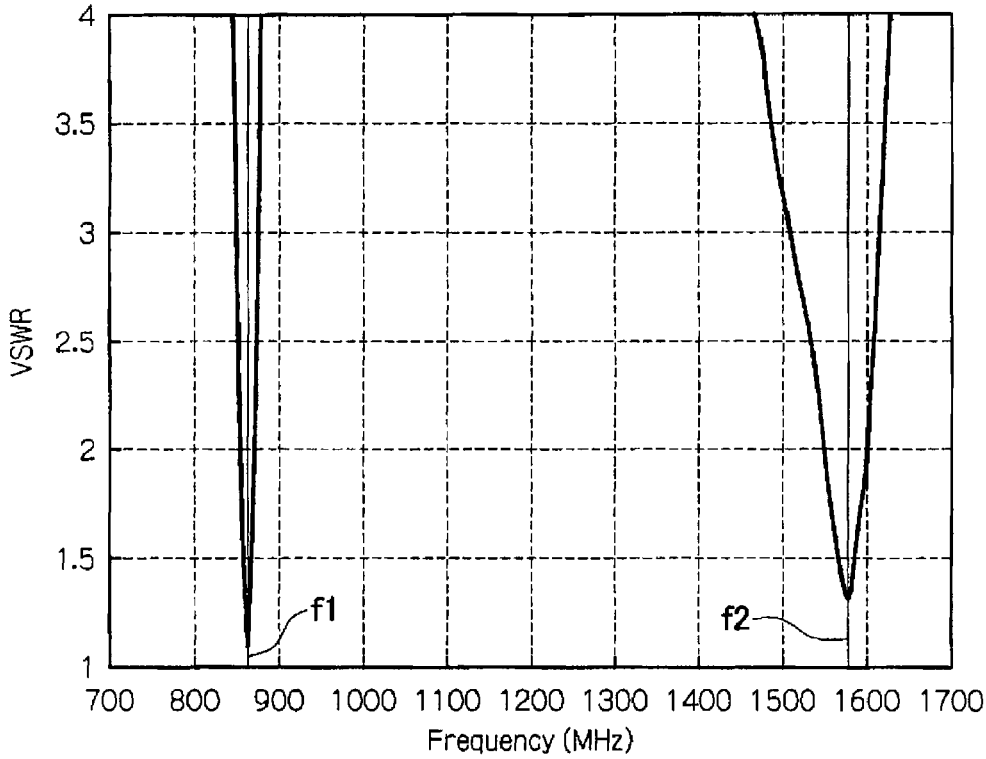
FIG. 12 is a graph showing a VSWR frequency characteristic of the antenna device according to the sixth embodiment of the present invention.

Next, referring to FIGS. 10 through 12, a fifth embodiment is described. Using the same reference signs for the component elements detailed in the aforementioned embodiments, re-explanations of these component elements are omitted in the following descriptions. A difference between the first and fifth embodiments is that; in the fifth embodiment, an antenna device 80 has a multiple-resonance capacitor section 81 which is connected in parallel with the conductor pattern 12.

In the antenna device 70 having such a construction, it is possible to obtain the same functions and effects as those of the antenna device 40 according to the second embodiment, and since the meander pattern 71 is connected to the front end of the loading section 4, it is possible to obtain an antenna device having a wide band or a high gain.

In addition, although the conductor pattern 12 has a helical shape formed by winding around the body 11 in the longitudinal direction in the antenna device 70 according to the aforementioned fifth embodiment, the conductor pattern may have a meander shape similar to the third embodiment.

Next, a sixth embodiment is described with reference to FIGS. 10 to 12. In addition, the later description, the components described in the aforementioned embodiment are denoted by the same reference numerals, and description thereof is omitted.

A difference between the first and sixth embodiments is as follows. In an antenna device 80 according to the sixth embodiment, a multiple-resonance capacitor section 81 is serially connected between both ends of the conductor pattern 12.

Namely, as shown in FIG. 10, the multiple-resonance capacitor section 81 includes planar conductors 83A and 83B which are formed on upper and lower surfaces of a body 82A, a straight line conductor 84A which connects the planar conductor 83A to a connection electrode 14A, and a straight line conductor 84B which connects the planar conductor 83B to a connection electrode 14B.

The body 82A is stacked on a surface of an elementary body 82B which is stacked on a surface of the elementary body 11. In addition, all the elementary bodies 82A and 82B are made of the same material as the elementary body 11.

The planar conductor 83A is a substantially rectangular conductor and formed on a rear surface of the elementary body 82A. In addition, the planar conductor 83B is a substantially rectangular conductor similar to the planar conductor 83A and formed on a surface of the body 82A to partially face the planar conductor 83A.

The planar conductors 83A and 83B are connected to both ends of the conductor pattern 12 through the straight line conductors 84A and 84B, respectively, and disposed to face each other through the body 82A, thereby forming a capacitor.

As shown in FIG. 11, in the antenna device 80, an antenna section 85 having a first resonance frequency is constructed with the loading section 4, the inductor section 5, the capacitor section 6, and the multiple-resonance capacitor section 81, and a multiple-resonance section 86 having a second resonance frequency is constructed with the multiple-resonance capacitor section 81 and the loading section 4.

FIG. 12 shows a VSWR characteristic of the antenna device 80. As shown in the figure, the antenna section 85 represents the first resonance frequency f1, the multiple-resonance section 86 represents the second resonance frequency f2 which is higher than the first resonance frequency f1. In addition, by adjusting a material used for the body 82A or a facing area of the planar conductors 83A and 83B, it is possible to easily change the second resonance frequency.

In the antenna device 80 having such a construction, it is possible to obtain the same functions and effects as those of the first embodiment, and the multiple-resonance capacitor section 81 is serially connected between both ends of the conductor pattern 12, there is provided the multiple-resonance section 86 having the second resonance frequency f2 different from the first resonance frequency f1 of the antenna section 85. Therefore, it is possible to a compact antenna device having two resonance frequencies, for example, 900 MHz for GSM (Global System for Mobile Communication) in Europe and 1.8 GHz for DCS (Digital Cellular System).

Figure 13:
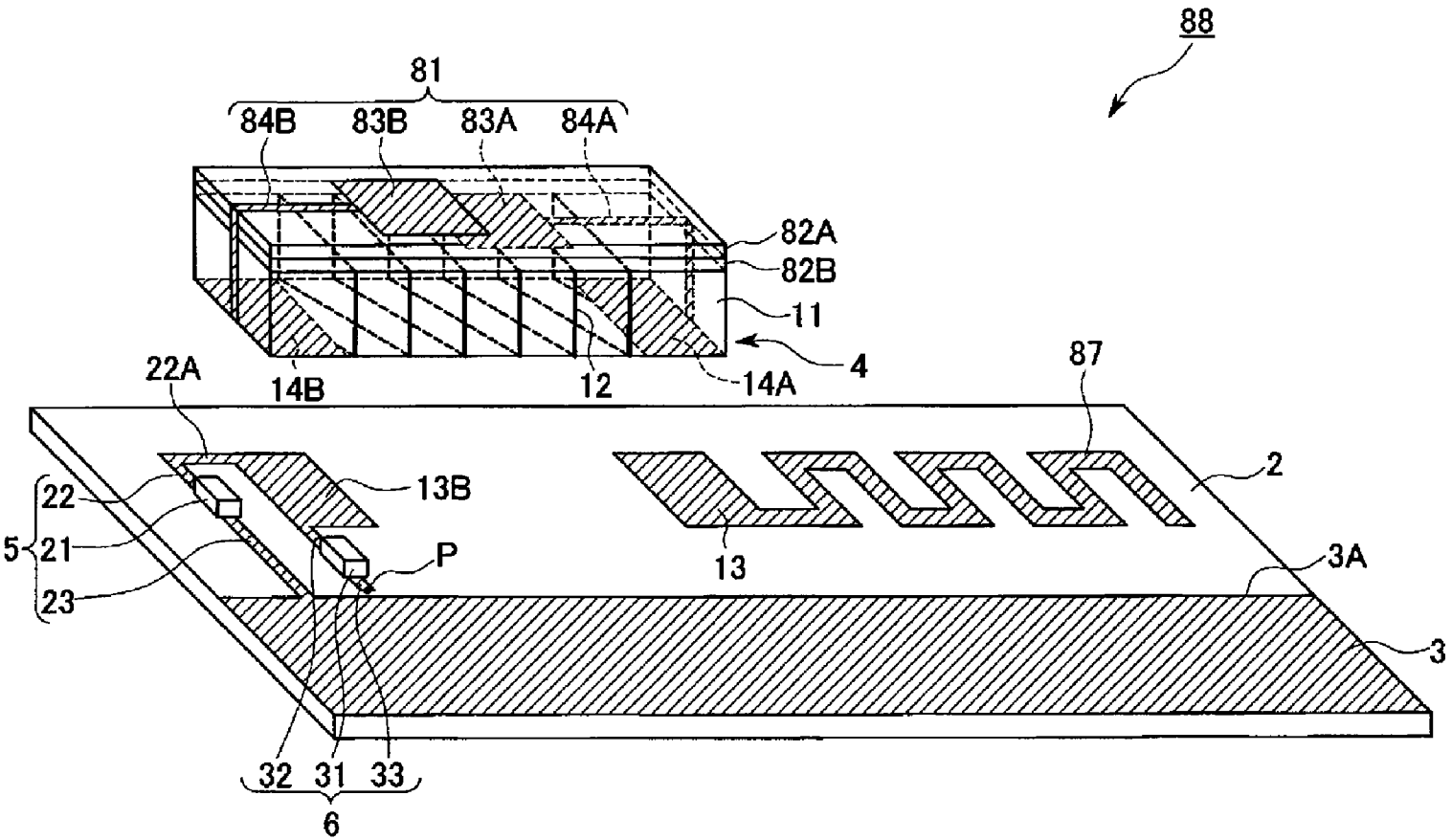
FIG. 13 is a perspective view showing an antenna device to which the present invention is applied rather than the sixth embodiment of the present invention.

In addition, according to the embodiment, as shown in FIG. 13, there may be provided an antenna device 88 having a meander pattern 87 formed on a front end portion of the loading section 4. In the antenna device 88, the meander pattern 87 having a meander shape is connected to the setting conductor 13A of the loading section 4 on a surface of the substrate 2.

The meander pattern 87 is disposed so that a long axis thereof is parallel to the conductor film 3.

In the antenna device 88 having such a construction, since the meander pattern 87 is connected to the front end of the loading section 4, it is possible to obtain an antenna device having a wide band or a high gain.

Next, a seventh embodiment is described with reference to FIGS. 14 to 15. In addition, the later description, the components described in the aforementioned embodiment are denoted by the same reference numerals, and description thereof is omitted.

A difference between the seventh and sixth embodiments is as follows. In the antenna device 80 according to the sixth embodiment, the single multiple-resonance capacitor section 81 is connected. However, in an antenna device 90 according to the seventh embodiment, a multiple-resonance capacitor section 91 is serially connected between two points, that is, a front end of the conductor pattern 12 and a substantially central point of the conductor pattern 12, and a multiple-resonance capacitor section 92 is serially connected between two points, that is, a base end of the conductor pattern 12 and the substantially central point of the conductor pattern 12.

Figure 14:
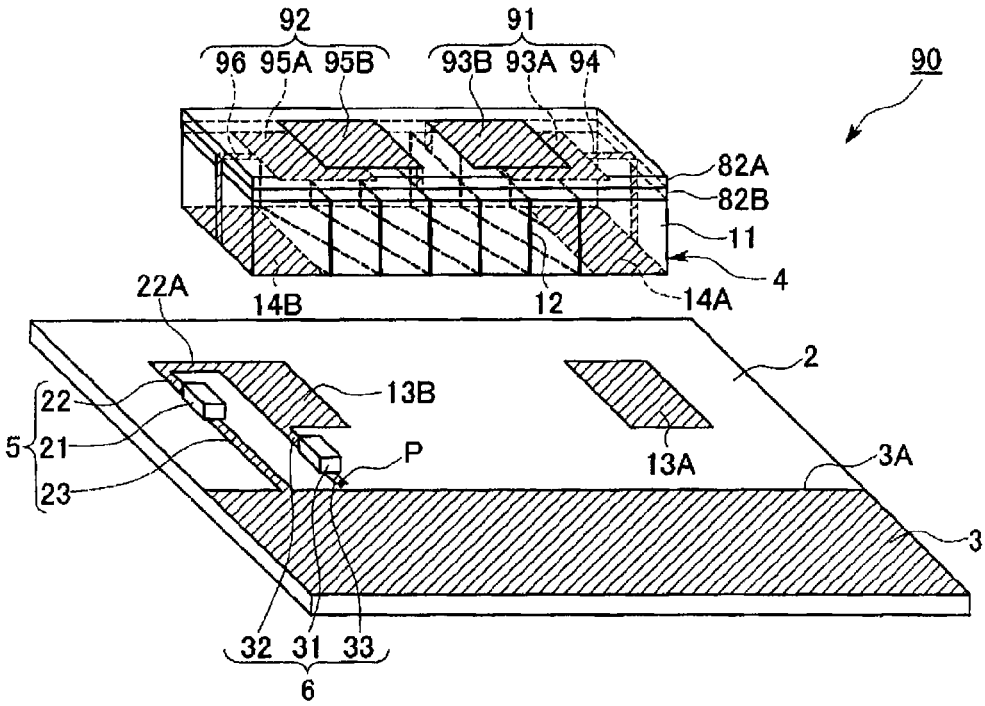
FIG. 14 is a perspective view showing an antenna device according to a seventh embodiment of the present invention.

Namely, as shown in FIG. 14, the multiple-resonance capacitor section 91 is constructed with planar conductors 93A and 93B formed on upper and lower surfaces of a body 82A and a straight line conductor 94 which connects the planar conductor 93A to the connection electrode 14A. In addition, similar to the multiple-resonance capacitor section 91, the multiple-resonance capacitor section 92 is constructed with planar conductors 95A and 95B and a straight line conductor 96 which connects the planar conductor 95B to the connection electrode 14B.

The planar conductor 93A is a substantially rectangular conductor and formed on a rear surface of the body 82A. In addition, similar to the planar conductor 93A, the planar conductor 93B has a substantially rectangular shape and formed to partially face the planar conductor 93A on a surface of the body 82A. The planar conductor 95A is a substantially rectangular conductor and formed on an upper surface of the body 82A. In addition, similar to the planar conductor 95A, the planar conductor 95B has a substantially rectangular shape and formed to partially face the planar conductor 95A on the rear surface of the body 82A.

In addition, the planar conductors 93B and 95A are formed not to be in contact with each other.

The planar conductors 93A and 95B are connected through straight line conductors 94 and 96 to both ends of the conductor pattern, respectively. In addition, the planar conductors 93B and 95A are connected to a center of the conductor pattern 12 via through-holes passing through the elementary bodies 82A and 82B and filled with a conductive member. In this manner, the planar conductors 93A and 93B are disposed to face each other through the body 82A to constitute a capacitor, and the planar conductors 95A and 95B are disposed to face each other to constitute another capacitor.

Figure 15:
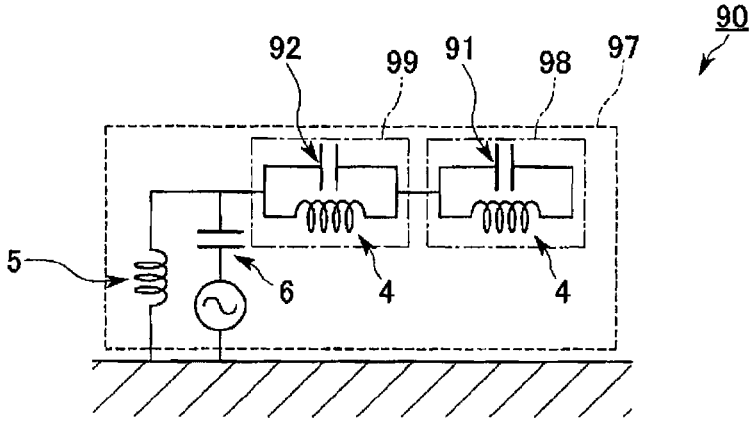
FIG. 15 is an equivalent circuit view showing the antenna device according to the seventh embodiment of the present invention.

As shown in FIG. 15, in the antenna device 90, an antenna section 97 having a first resonance frequency is constructed, a first multiple-resonance section 98 having a second resonance frequency is constructed with the multiple-resonance capacitor section 91 and the conductor pattern 12 between two points connected thereto, and a second multiple-resonance section 99 having a third resonance frequency is constructed with the multiple-resonance capacitor section 92 and the conductor pattern 12 between two points connected thereto.

Figure 16:
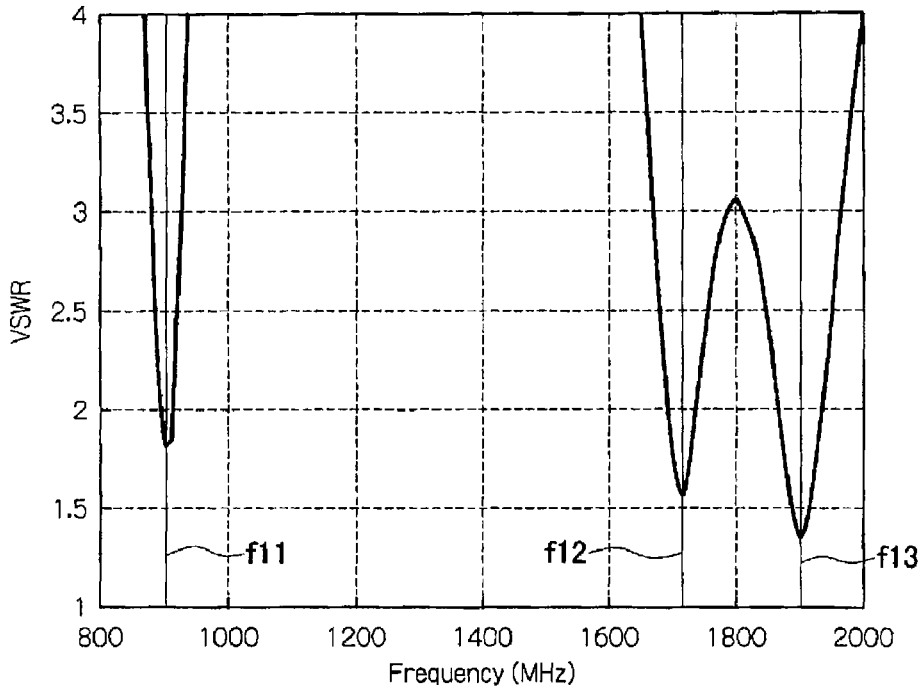
FIG. 16 is a graph showing a VSWR frequency characteristic of the antenna device according to the seventh embodiment of the present invention.

FIG. 16 shows a VSWR characteristic of the antenna device 90. As shown in the figure, the antenna section 97 represents the first resonance frequency f11, the first multiple-resonance section 98 represents the second resonance frequency f12 which is higher than the first resonance frequency f11, and the second multiple-resonance section 99 represents the third resonance frequency f13 which is higher than the second resonance frequency f12. In addition, by adjusting a material used for the body 82A or a facing area of the planar conductors 93A and 93B, it is possible to change the second resonance frequency. Similarly, by adjusting a material used for the body 82A or a facing area of the planar conductors 95A and 95B, it is possible to change the third resonance frequency.

In the antenna device 90 having such a construction, it is possible to obtain the same functions and effects as those of the sixth embodiment, and since the two multiple-resonance capacitor sections 91 and 92 are serially connected between two points of the conductor pattern 12, the first multiple-resonance section 98 having the second resonance frequency f12 and the second multiple-resonance section 99 having the third resonance frequency f13 are formed. Therefore, it is possible to a compact antenna device having three resonance frequencies, for example, for GSM, DCS, and PCS (Personal Communication Services).

In addition, according to the embodiment, similar to the aforementioned sixth embodiment, there may be provided a meander pattern 87 having a meander shape and connected to the setting conductor 13A of the loading section 4.

Next, an eighth embodiment is described with reference to FIGS. 17 to 19. In addition, the later description, the components described in the aforementioned embodiment are denoted by the same reference numerals, and description thereof is omitted.

A difference between the eighth and seventh embodiments is as follows. In the antenna device 90 according to the seventh embodiment, the capacitor is formed by facing the two planar conductors through the body 82A. However, in an antenna device 100 according to the eighth embodiment, there are provided multiple-resonance capacitor sections 101 and 102 constituting a capacitor using a parasite capacitance generated with respect to the conductor pattern 12.

Figure 17:
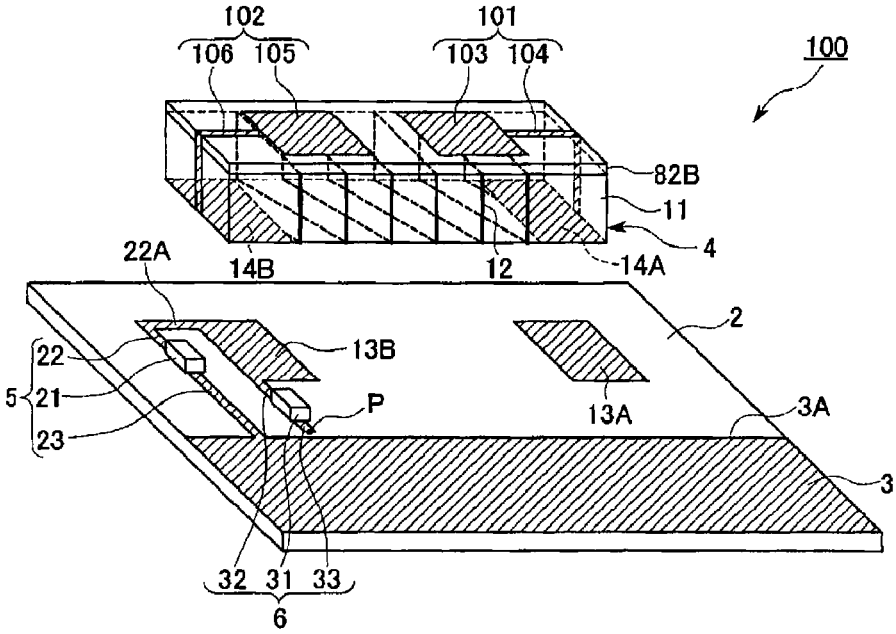
FIG. 17 is a perspective view showing an antenna device according to an eighth embodiment of the present invention.

As shown in FIG. 17, the multiple-resonance capacitor section 101 is constructed with a planar conductor 103 formed on an upper surface of the body 82A and a straight line conductor 104 which connects the planar conductor 103 to the connection electrode 14A. In addition, the multiple-resonance capacitor section 102 is constructed with a planar conductor 105 formed on an upper surface of the body 82A and a straight line conductor 106 which connects the planar conductor 105 to the connection electrode 14B.

The planar conductor 103 is a substantially rectangular conductor and formed on a rear surface of the body 82B. In addition, similar to the planar conductor 103, the planar conductor 105 has a substantially rectangular shape and formed on a surface of the body 82B. In this manner, the planar conductor 103 and the conductor pattern 12 are disposed to face each other through the body 82B, so that a capacitor is equivalently formed due to a parasite capacitance between the planar conductor 103 and the conductor pattern 12. In addition, similarly, the planar conductor 105 and the conductor pattern 12 are disposed to face each other through the body 82B, so that another capacitor is equivalently formed due to a parasite capacitance between the planar conductor 105 and the conductor pattern 12.

In addition, the planar conductors 103 and 105 are formed not to be in contact with each other.

Figure 18:
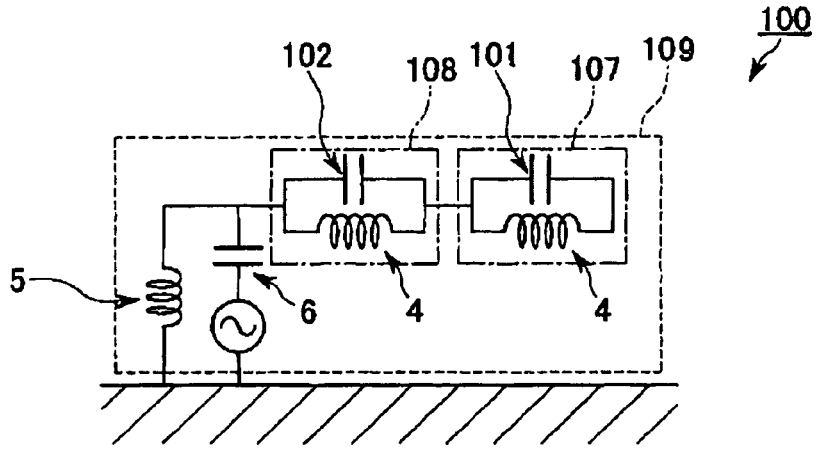
FIG. 18 is an equivalent circuit view showing the antenna device according to the eighth embodiment of the present invention.

As shown in FIG. 18, in the antenna device 100, an antenna section 109 having a first resonance frequency is constructed with the loading section 4, the inductor section 5, and the capacitor section 6, a first multiple-resonance section 107 having a second resonance frequency is constructed with the multiple-resonance capacitor section 101 and the conductor pattern 12 between two points connected thereto, and a second multiple-resonance section 108 having a third resonance frequency is constructed with the multiple-resonance capacitor section 102 and the conductor pattern 12 between two points connected thereto.

Figure 19:
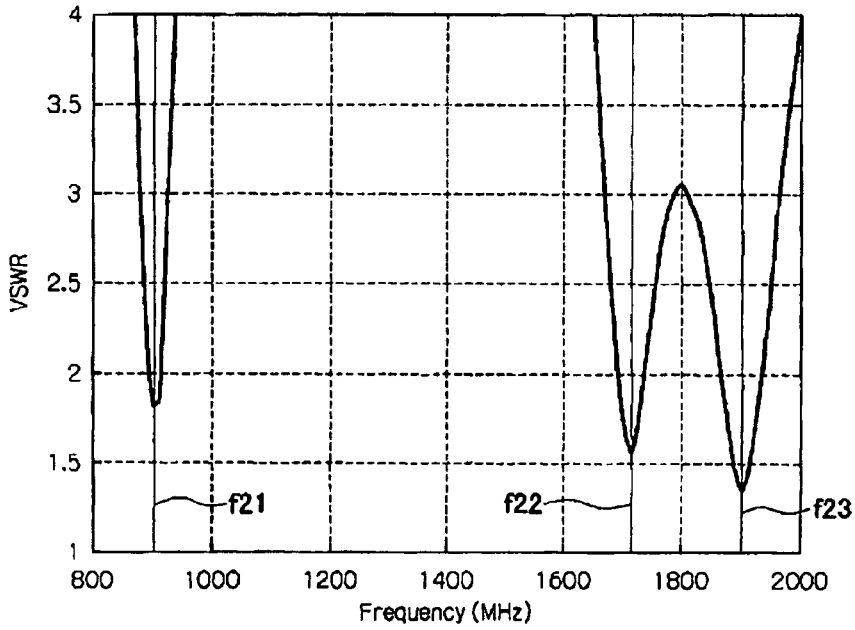
FIG. 19 is a graph showing a VSWR frequency characteristic of the antenna device according to the eighth embodiment of the present invention.

FIG. 19 shows a VSWR characteristic of the antenna device 100. As shown in the figure, the antenna section 109 represents the first resonance frequency f21, the first multiple-resonance section 107 represents the second resonance frequency f22 which is higher than the first resonance frequency f21, and the second multiple-resonance section 108 represents the third resonance frequency f23 which is higher than the second resonance frequency f22. In addition, by adjusting a material used for the body 82B or an area of the planar conductor 103, it is possible to easily change the second resonance frequency. Similarly, by adjusting a material used for the body 82A or an area of the planar conductor 105, it is possible to easily change the third resonance frequency.

In the antenna device 100 having such a construction, it is possible to obtain the same functions and effects as those of the seventh embodiment, and since the planar conductors 103 and 105 are disposed to face the conductor pattern 12 and the first and second multiple-resonance sections 107 and 108 are formed using the parasite capacitances, it is possible to easily construct the antenna device.

In addition, according to the embodiment, similar to the aforementioned sixth embodiment, there may be provided a meander pattern 87 having a meander shape and connected to the setting conductor 13A of the loading section 4.

Next, an antenna apparatus according to a ninth embodiment is described with reference to FIGS. 20 to 23.

Figure 20:
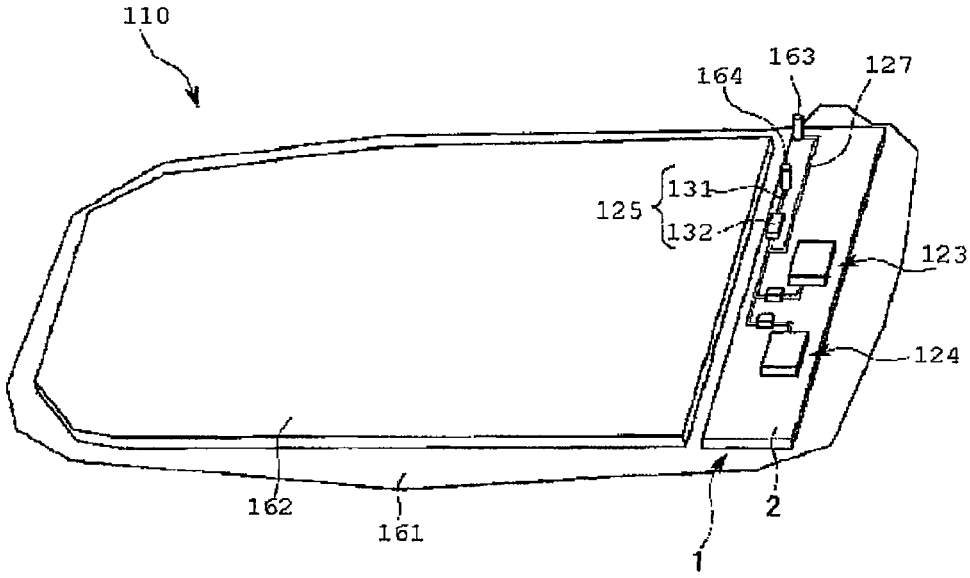
FIG. 20 shows a mobile phone according to a ninth embodiment of the present invention, (a) is a perspective view thereof, and (b) is a perspective view showing an antenna device.
Figure 20:
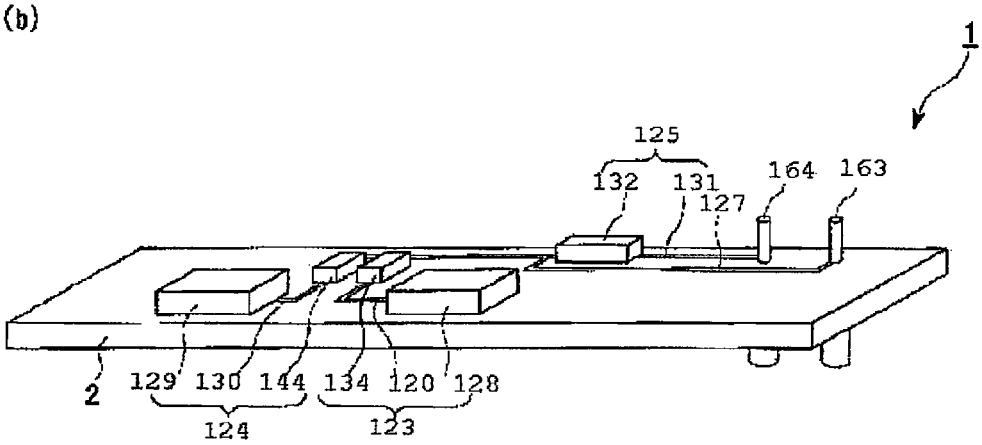

The antenna device 1 according to the embodiment is an antenna device used for a mobile phone 110 shown in FIG. 20 applied to, for example, a reception frequency band of PDC (Personal Digital Cellular) using 800 MHz and GPS (Global Positioning System) using 1.5 GHz.

As shown in FIG. 20, the mobile phone 110 includes a base 161, a main circuit substrate 162 which is disposed in an inner portion of the base 161 and provided with a communication control circuit including a radio frequency circuit, and the antenna device 1 which is connected to the radio frequency circuit provided to main circuit substrate 162. In addition, the antenna device 1 is provided with a feed pin 163 which connects a later-described feed section 126 to the radio frequency circuit of the main circuit substrate 162 and a GND pin 164 which connects a later-described conductor pattern 136 to a ground of the main circuit substrate 162.

Hereinafter, the antenna device 1 is described with reference to a schematic view of the antenna device.

Figure 21:
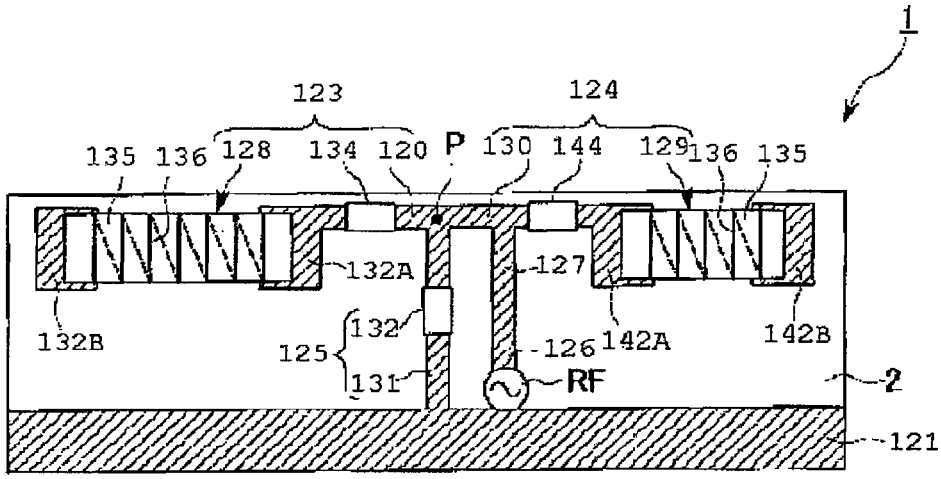
FIG. 21 is a schematic diagram showing the antenna device according to the ninth embodiment of the present invention.

As shown in FIG. 21, the antenna device 1 includes a substrate 2 which is made of an insulating material such as a resin, a rectangular conductor film 121 disposed on a surface of the substrate 2, first and second loading sections 123 and 124 which are disposed on the surface of the substrate 2 to be parallel to the conductor film 121, an inductor section 125 which connects base ends of the first and second loading sections 123 and 124 to the conductor film 121, a feed section 126 which feeds a current to a connection point P of the first and second loading sections 123 and 124 and the inductor section 125, and a feed conductor 127 which connects the connection point P to the feed section 126.

The first loading section 123 includes a first loading element 128, lands 132A and 132B which are disposed on a surface of the substrate 2 to be used to mount the first loading element 128 on the substrate 2, a connection conductor 120 which connects the land 132A to the connection point P, and a lumped element circuit 134 which is formed on the connection conductor 120 and connects a division portion (not shown) for dividing the connection conductor 120.

Figure 22:
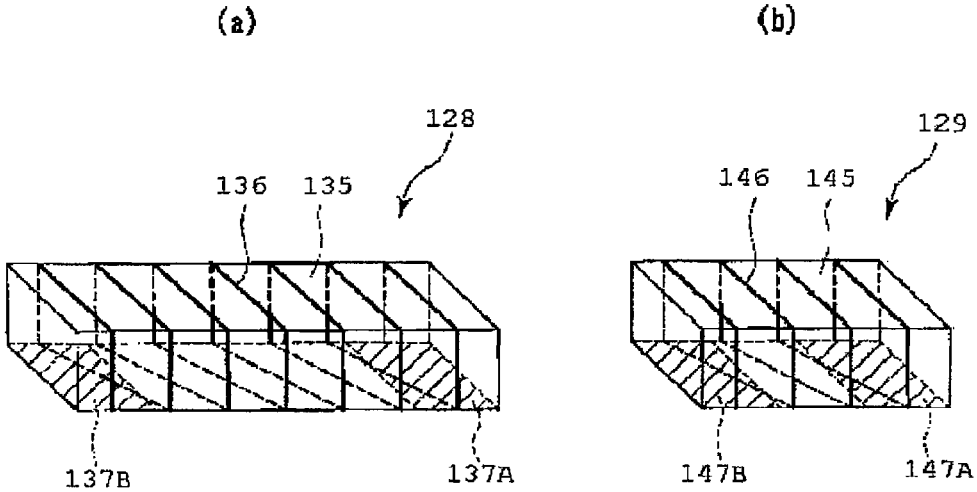
FIG. 22 (*a*) is a perspective view showing a first loading device in FIG. 20, and FIG. 22 (*b*) is a perspective view showing a second loading device.

As shown in FIG. 22 (*a*), the first loading element 128 is constructed with a rectangular parallelepiped body 135 made of a dielectric material such as alumina and a line-shaped conductor pattern 136 wound around a surface of the body 135 in a longitudinal direction thereof in a helical shape. Both ends of the conductor pattern 136 are connected to connection conductors 137A and 137B disposed on a rear surface of the body 135, respectively, so as to be connected to the lands 132A and 132B.

The lumped element circuit 134 is constructed with, for example, a chip inductor.

In addition, the second loading section 124 is disposed to face the first loading section 123 through the connection point P, and, similar to the first loading section 123, includes a second loading element 129, lands 142A and 142B, a connection conductor 130, and a lumped element circuit 134.

As shown in FIG. 22 (*b*), similar to the first loading element 128, the second loading element 129 is constructed with a body 145 and a conductor pattern 146 wound around a surface of the body 145.

Both ends of the conductor pattern 146 are connected to connection conductors 147A and 147B formed on a rear surface of the body 145 so as to be connected to the lands 142A and 142B.

The inductor section 125 includes a conductor film connection pattern 131 which connects the connection conductors 120 and 130 to the conductor film 121 and a chip inductor 132 which is disposed on the conductor film connection pattern 131 and connects a division portion (not shown) for dividing the conductor film connection pattern 131.

In addition, the feed conductor 127 has a straight line shaped pattern for connecting the connection conductor 130 to the feed section 126 connected to the radio frequency circuit RF.

In addition, by suitably adjusting a length of the feed conductor 127, impedance matching at the feed section 126 can be obtained.

Figure 23:
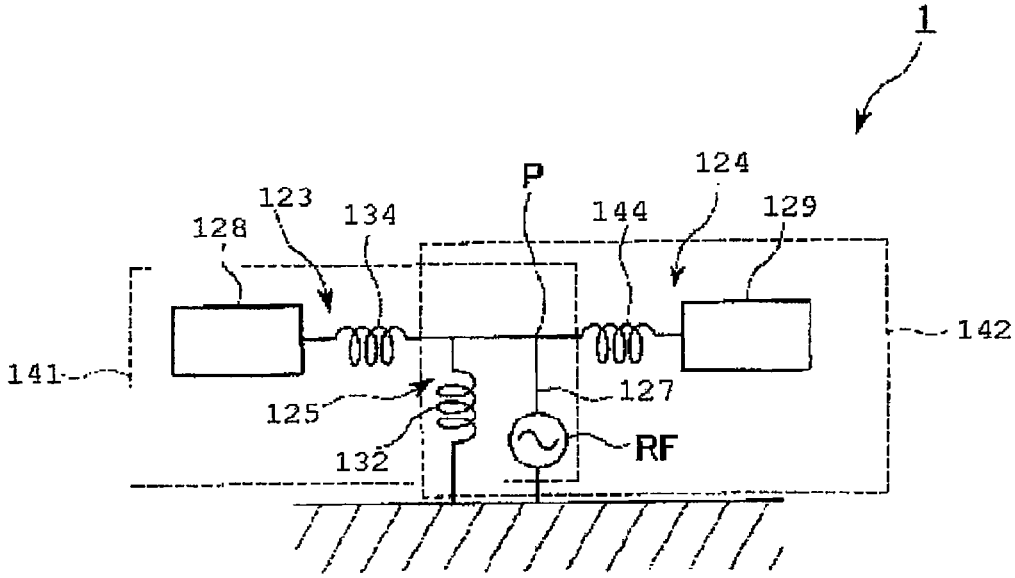
FIG. 23 is a schematic diagram showing the antenna device in FIG. 20.

As shown in FIG. 23, in the antenna device 1, the first antenna section 141 is constructed with the first loading section 123, the inductor section 5, and the feed conductor 127, and the second antenna section 142 is constructed with the second loading section 124, the inductor section 5, and the feed conductor 127.

The first antenna section 141 is constructed to have a first resonance frequency by adjusting an electrical length thereof using a length of the conductor pattern 136, an inductance of the lumped element circuit 134, or an inductance of the chip inductor 132.

In addition, similar to the first resonance frequency f1, the second antenna section 142 is constructed to have a second resonance frequency by adjusting an electrical length thereof using a length of the conductor pattern 146, an inductance of the lumped element circuit 134, or an inductance of the chip inductor 132.

In addition, the first and second loading sections 123 and 124 are constructed to have physical lengths to be shorter than ¼ of antenna operating wavelengths of the first and second antenna sections 141 and 142. By doing so, self resonance frequencies of the first and second loading sections 123 and 124 are higher than first and second resonance frequencies, that is, the antenna operating frequencies of the antenna device 1. Therefore, in terms of the first and second resonance frequencies, the first and second loading sections 123 and 124 are not considered to perform self resonance, so that a property thereof is different from that of a helical antenna which performs the self resonance with the antenna operating frequency.

Figure 24:
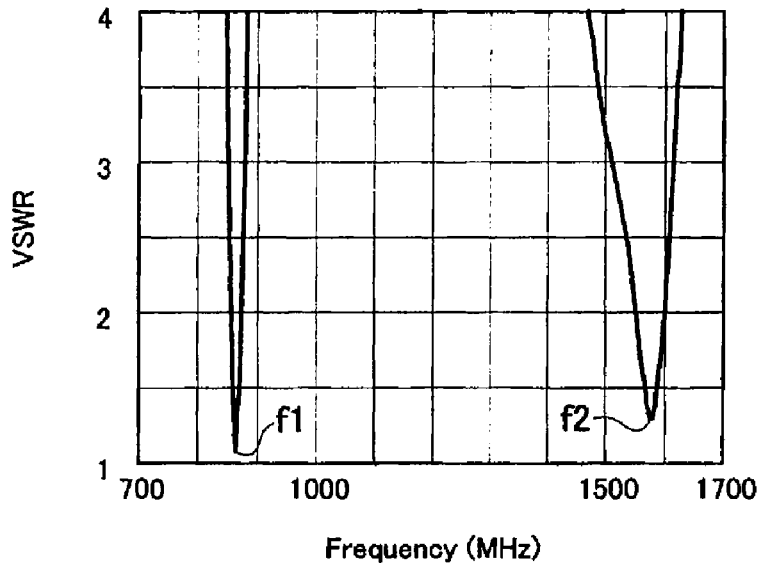
FIG. 24 is a graph showing a VSWR characteristic of the antenna in FIG. 20.
Figure 24:
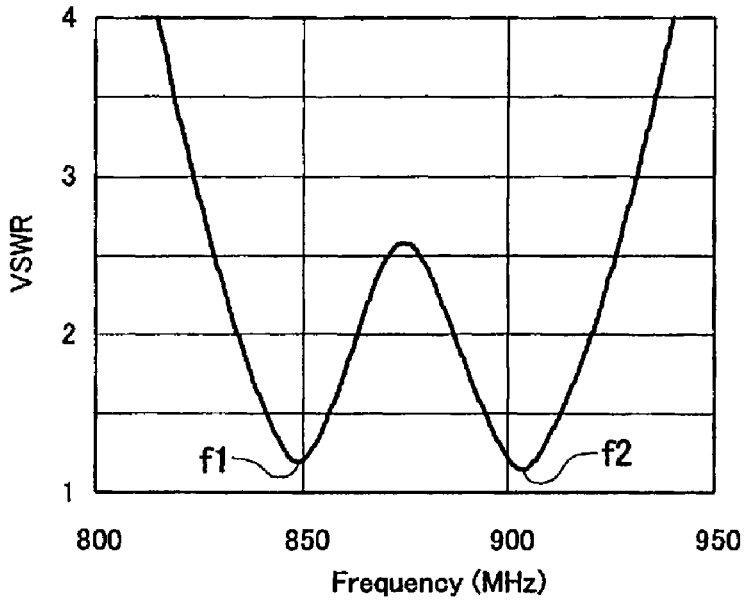

FIG. 24 (*a*) shows a VSWR (Voltage Standing Wave Ratio) characteristic of the antenna device 1. As shown in the figure, the first antenna section 141 represents a first resonance frequency f1, and the second antenna section 142 represents a second resonance frequency f2 which is higher than the first resonance frequency f1.

In addition, as shown in FIG. 24 (*a*), the first resonance frequency f1 is arranged to cope with a reception frequency band for PDC, and the second resonance frequency f2 is arranged to cope with a band of 1.5 GHz for GPS. However, as described above, by suitably adjusting the electrical lengths of the first and second antenna sections 141 and 142, the first resonance frequency f1 may be arranged to cope with a reception frequency band, and the second resonance frequency f2 may be arranged to cope with a transmission frequency band as shown in FIG. 24 (*b*).

In the antenna device 1 having such as a construction, although the physical length of the antenna element parallel to the conductor film 121 is shorter than ¼ of the antenna operating wavelength, the electrical length becomes ¼ of the antenna operating wavelength due to a combination of the first and second loading sections 123 and 124 and the inductor section 125. Therefore, in terms of the physical length, the antenna device can be miniaturized greatly.

In addition, due to the lumped element circuits 134 and 144 provided to the first and second loading sections 123 and 124, it is possible to set the first and second resonance frequencies f1 and f2 without adjusting lengths of the conductor patterns 136 and 146. By doing so, when the first and second resonance frequencies f1 and f2 are set, there is no need to change the number of windings of the conductor patterns 126 and 136 according to such conditions as ground size of a case where the antenna device 1 is mounted, and there is no need to change sizes of the first and second loading elements 128 and 129 according to a change in the number of windings. Therefore, it is possible to easily set the first and second resonance frequencies f1 and f2.

Figure 25:
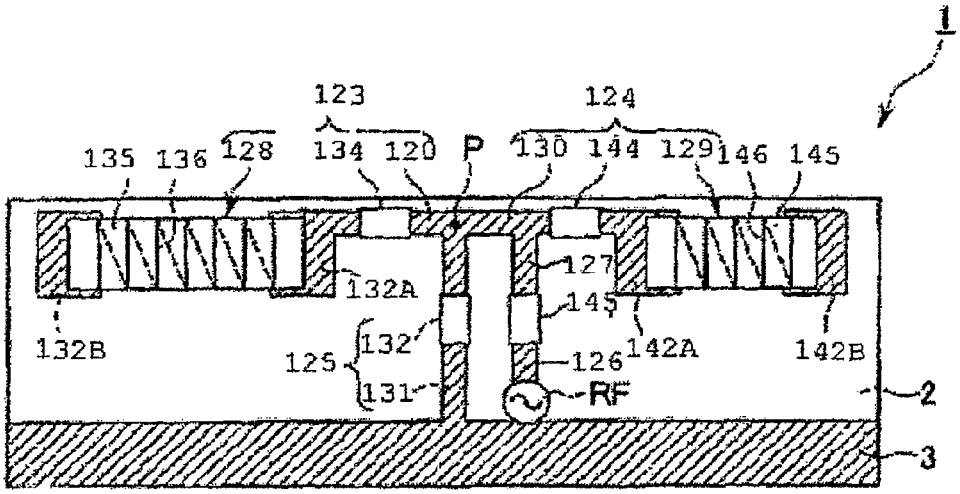
FIG. 25 is a schematic plan view showing an external antenna to which the present invention is applied rather than the ninth embodiment of the present invention.

In addition, in the embodiment, as shown in FIG. 25, there may be provided an impedance adjusting section 148 between the connection point P and the feed section 126.

The impedance adjusting section 148 may be constructed with, for example, a chip capacitor and disposed to be connected to a division portion (not shown) for dividing the feed conductor 127. As a result, by adjusting a capacitance of the chip capacitor, it is possible to easily match the impedance at the feed section 126.

Next, a tenth embodiment is described with reference to FIGS. 26 and 27. In addition, the later description, the components described in the aforementioned embodiment are denoted by the same reference numerals, and description thereof is omitted.

A difference between the tenth and ninth embodiments is as follows. In the antenna device 1 according to the ninth embodiment, the first antenna section 141 is constructed with the first loading section 123, the inductor section 5, and the feed conductor 127. However, in an antenna device 50 according to the tenth embodiment, a first antenna section is constructed with the first loading section 123, the inductor section 5, and the feed conductor 127, and a meander pattern 151 disposed on a front end of the first loading section 123.

Figure 26:
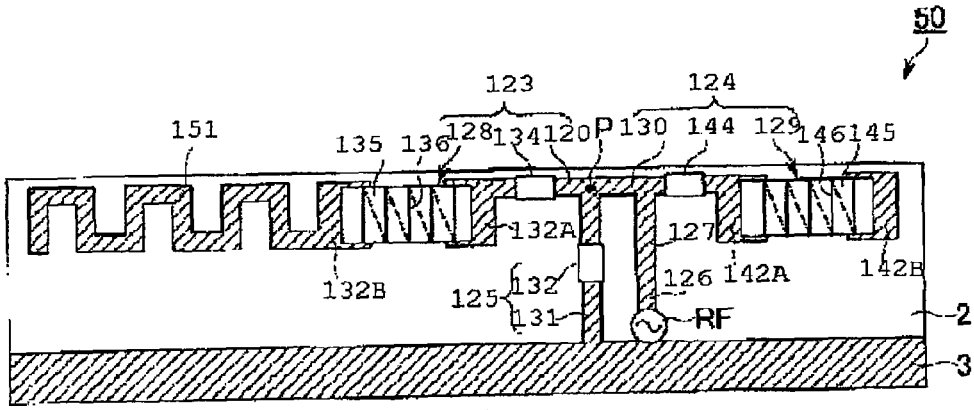
FIG. 26 is a schematic view showing an antenna device according to a tenth embodiment of the present invention.

Namely, as shown in FIG. 26, a meander pattern 151 is formed in a meander shape and connected to a land 132B of the first loading section 123 on a surface of the substrate 2.

The meander pattern 151 is disposed so that a long axis thereof is parallel to the conductor film 3.

Figure 27:
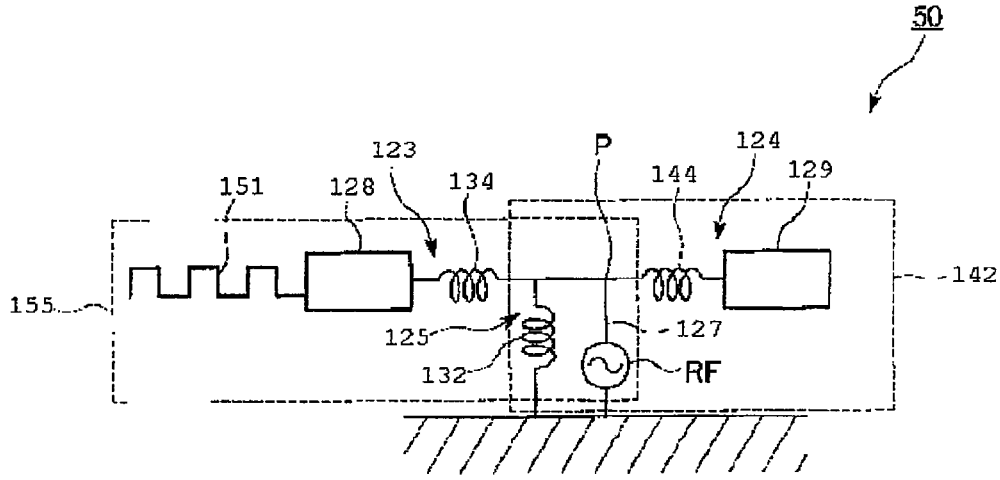
FIG. 27 is a schematic view showing the antenna device in FIG. 26.

As shown in FIG. 27, in the antenna device 50, a first antenna section 155 having a first resonance frequency is constructed with the first loading section 123, the meander pattern 151, the inductor section 125, and the feed conductor 127, and the second antenna section 142 having a second resonance frequency is constructed with the second loading section 124, the inductor section 5, and the feed conductor 127.

In the antenna device 50 having such a construction, it is possible to obtain the same functions and effects as those of the antenna device 1 according to the ninth embodiment, and since the first loading section 123 is connected to the meander pattern 151, it is possible to obtain a first antenna section 155 having a wide band or a high gain.

In addition, in the embodiment, the meander pattern 151 may be connected to a front end of the second loading section 124 or front ends of the first and second loading sections 123 and 124.

In addition, similar to the ninth embodiment, an impedance adjusting section 148 may be formed between the connection point P and the feed section 126.

Figure 28:
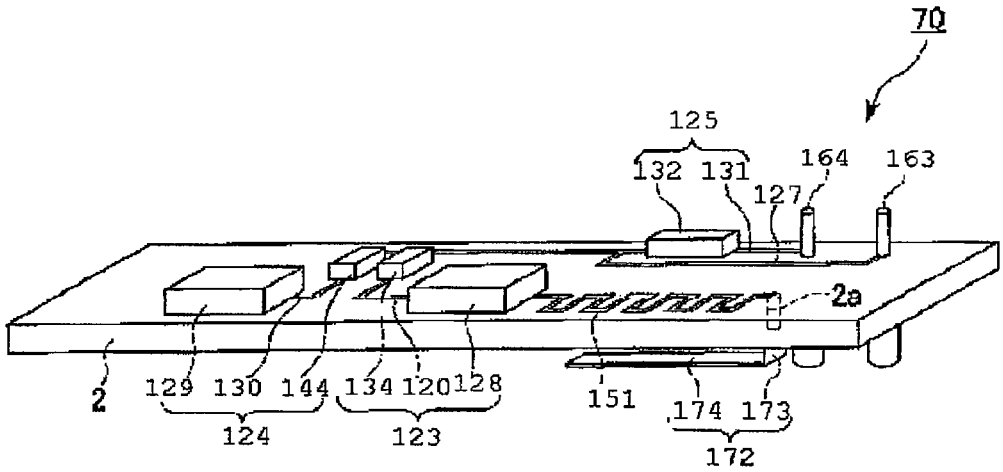
FIG. 28 is a perspective view showing an antenna device according to an eleventh embodiment of the present invention.
Figure 29:
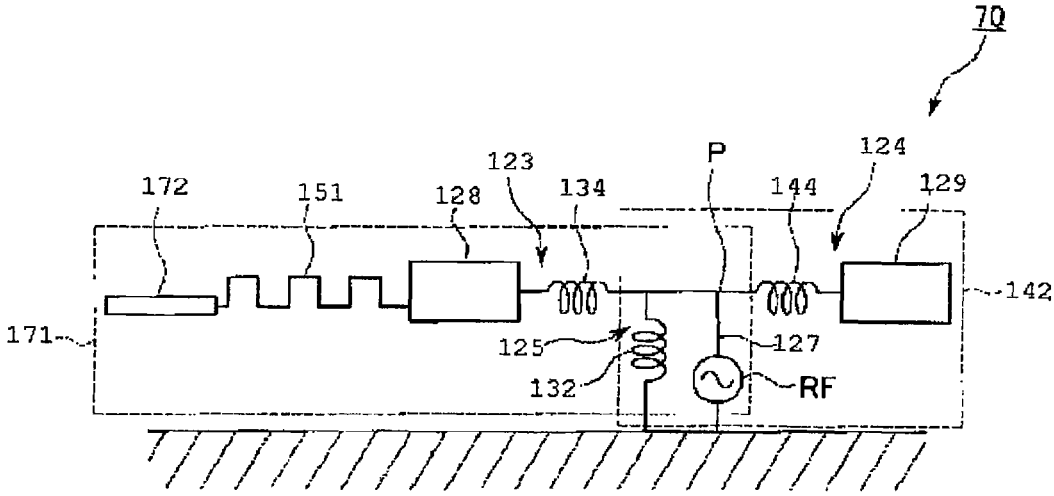
FIG. 29 is a schematic view showing the antenna device in FIG. 28.

Next, an eleventh embodiment is described with reference to FIGS. 28 and 29. In addition, the later description, the components described in the aforementioned embodiment are denoted by the same reference numerals, and description thereof is omitted.

A difference between the eleventh and tenth embodiments is as follows. In the antenna device 50 according to the tenth embodiment, the first antenna section is constructed with the first loading section 123, the inductor section 5, the feed conductor 127, and the meander pattern 151 disposed at the front end of the first loading section 4. However, in an antenna device 70 according to the eleventh embodiment, a first antenna section 171 includes an extension member 172 connected to the front end of the meander pattern 151.

Namely, the extension member 172 is a substantially L-shaped curved flat metal member and constructed with a substrate mounting portion 173 of which one end is mounted and fixed on a rear surface of the substrate 2 and an extension portion 174 which is arranged to be curved from the other end of the substrate mounting portion 173.

The substrate mounting portion 173 is fixed on the substrate by using, for example, a solder and connected via a through-hole 102A formed in the substrate 2 to a front end of the meander pattern 151 disposed on a surface of the substrate 2.

The extension portion 174 has a plate surface to be substantially parallel to the substrate 2 and a front end to face the first loading element 128. In addition, a length of the extension member 172 is suitably set according the first resonance frequency of the first antenna section 171.

Figure 30:
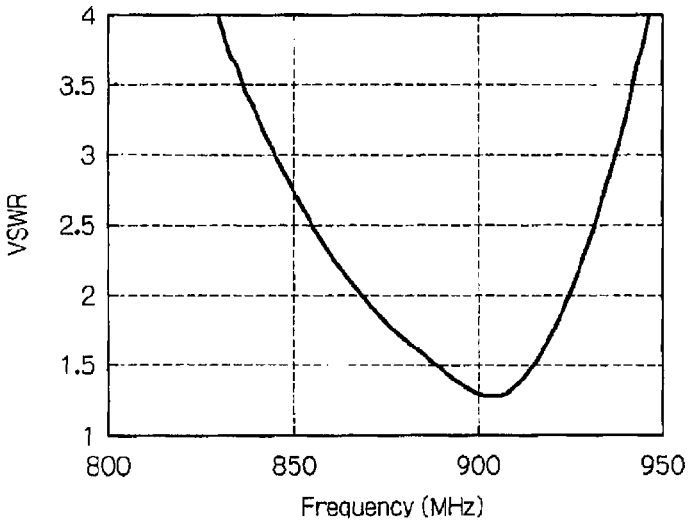
FIG. 30 is a graph showing a VSWR frequency characteristic of the antenna in FIG. 28.

Here, a VSWR frequency characteristic of the antenna device 70 at a frequency of from 800 MHz to 950 MHz is shown in FIG. 30.

As shown in FIG. 30, the VSWR becomes 1.29 at a frequency of 906 MHz, and a bandwidth becomes 55.43 MHz at the VSWR of 2.0.

Figure 31:
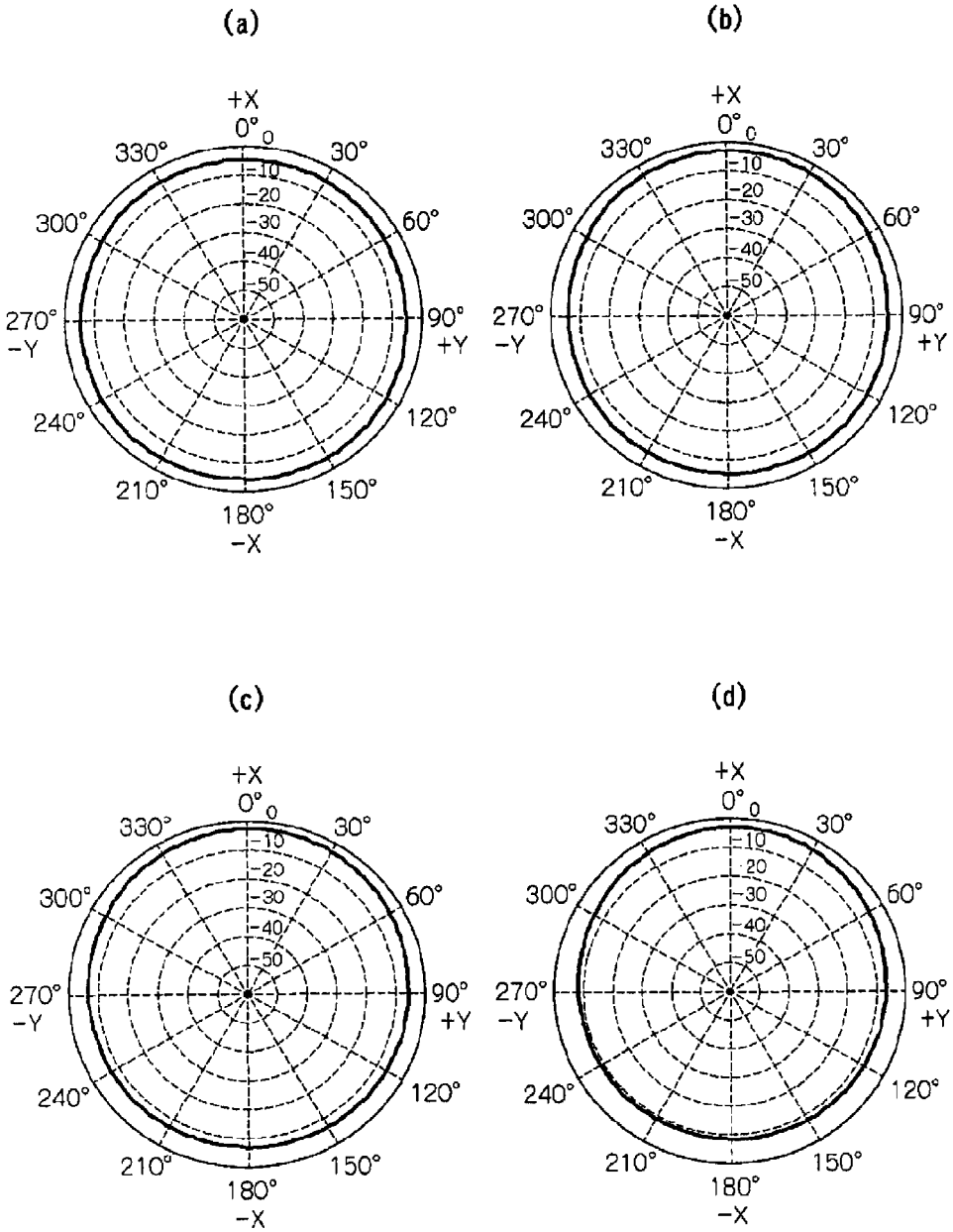
FIG. 31 is a graph showing a directionality of the antenna in FIG. 28.

In addition, a directionality of a radiation pattern in the XY plane of a vertical polarization wave at frequencies is shown in FIG. 31. Here, FIG. 31 (*a*) shows a directionality at a frequency of 832 MHz, FIG. 31 (*b*) shows a directionality at a frequency of 851 MHz, FIG. 31 (*c*) shows a directionality at a frequency of 906 MHz, and FIG. 31 (*d*) shows a directionality at a frequency of 925 MHz.

At the frequency of 832 MHz, a maximum value is −4.02 dBd, a minimum value is −6.01 dBd, and an average value is −4.85 dBd. In addition, at the frequency of 851 MHz, a maximum value is −3.36 dBd, a minimum value is −6.03 dBd, and an average value is −4.78 dBd. In addition, at the frequency of 906 MHz, a maximum value is −2.49 dBd, a minimum value is −7.9 dBd, and an average value is −5.19 dBd. In addition, at the frequency of 925 MHz, a maximum value is −3.23 dBd, a minimum value is −9.61 dBd, and an average value is −6.24 dBd.

In the antenna device 70 having such a construction, it is possible to obtain the same functions and effects as those of the antenna device 50 according to the ninth embodiment, and since the extension member 172 is connected to the front end of the meander pattern 151, it is possible to form the first antenna section 171 having a wide band or a high gain.

In addition, since the extension portion 174 is disposed to face the first loading element 128, it is possible to efficiently use an inner space of a case of a mobile phone including the antenna device 70. In addition, since the extension portion 174 is disposed to be separated from the substrate 2, it is possible to reduce influence of a high frequency current flowing through the first loading element 128 and the meander pattern 151.

In addition, in the embodiment, similar to the tenth embodiment, the extension member 172 may be connected to the front end of the second loading section 124 or to the front ends of the first and second loading sections 123 and 124.

In addition, the extension member 172 may be provided to a surface of the substrate 2.

In addition, similar to the aforementioned eighth and tenth embodiments, an impedance adjusting section 148 may be disposed between the connection point P and the feed section 126.

Hereinafter, a communication apparatus according to a twelfth embodiment of the present invention is described with reference to the accompanying FIGS. 32 to 36.

Figure 32:
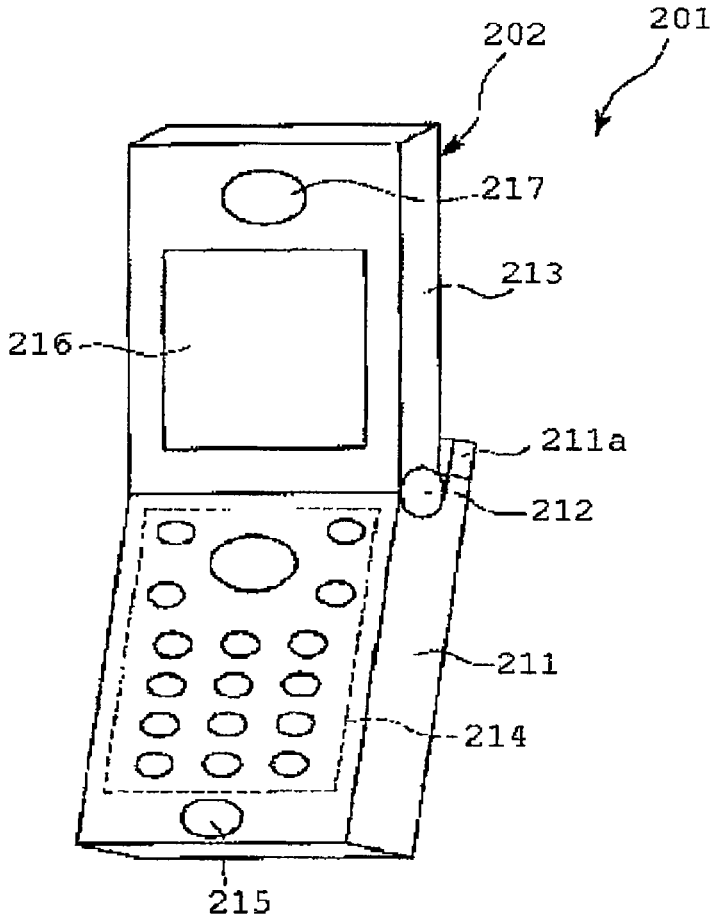
FIG. 32 is a perspective view showing an outer appearance of a mobile phone according to a twelfth embodiment of the present invention.

The communication apparatus according to the embodiment is a mobile phone 201 shown in FIG. 32 and includes a case 202, a communication control circuit 203, and an antenna device 204.

The case 202 includes a first case body 211 and a second case body 213 which can be folded from the first case body 210 through a hinge mechanism 212.

On an inner surface of the unfolded first case body 211, there are provided operation key portion 214 inclining number keys or the like and a microphone 215 for inputting a sending voice. In addition, at one side wall of the first case body 211 which the hinge mechanism 212 is in contact with, an antenna receiving portion 211*a* for receiving the antenna device 204 shown in FIG. 33 is formed to protrude in the same direction as a long-axis direction of the first case body 211.

Figure 33:
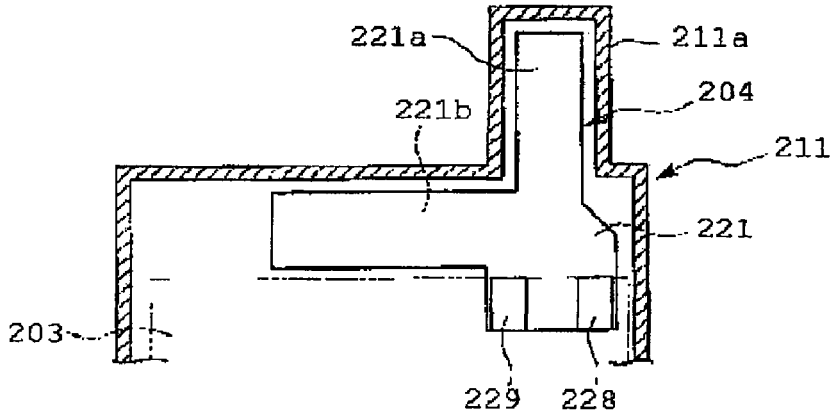
FIG. 33 is a cross sectional view showing a portion of a first case in FIG. 32.

In addition, as shown in FIG. 33, in an inner portion of the first case body 211, there is provided a communication control circuit 203 including a radio frequency circuit. The communication control circuit 203 is electrically connected to later-described control circuit connection port 228 and ground connection port 229 which are provided to the antenna device 204.

On an inner surface of the unfolded second case body 213, there are provided a display 216 for displaying characters and images and a speaker 217 for outputting a received voice.

Figure 34:
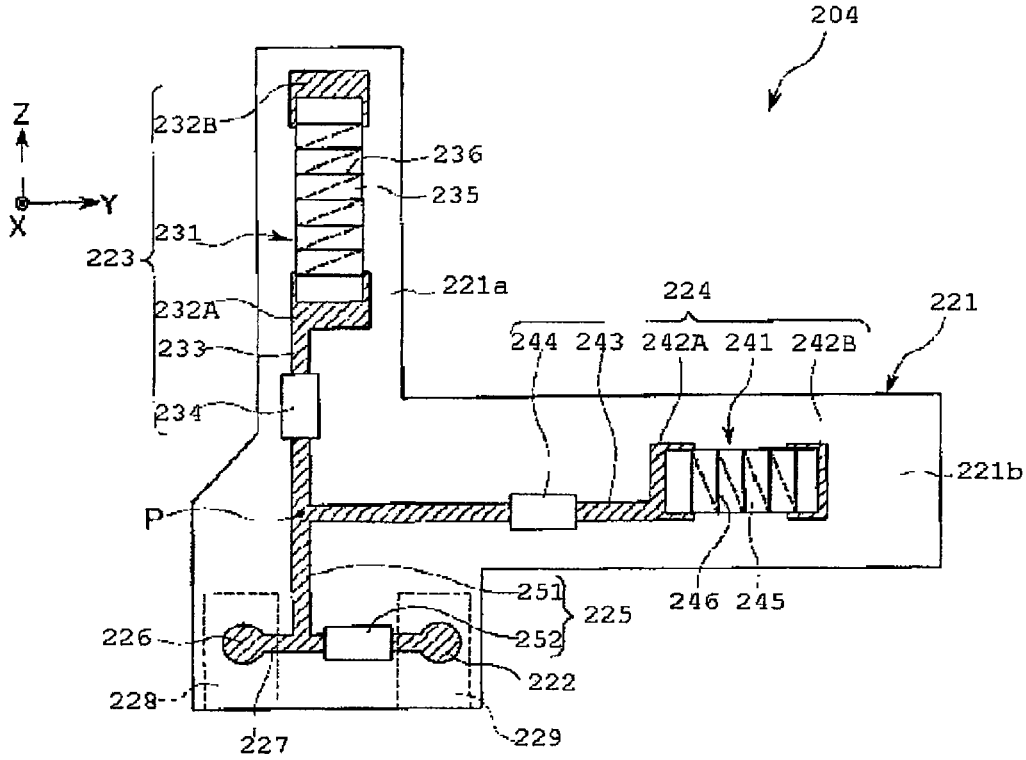
FIG. 34 is a plan view showing an antenna device in FIG. 33.

As shown in FIG. 34, the antenna device 204 include a substrate 221, a ground connection conductor (ground connection portion) 222 formed on the substrate 221, a first loading section 223 which is disposed on a surface of the substrate 221 so as for a longitudinal direction thereof to be parallel to a long axis direction of the first case body 211, a second loading section 224 which is disposed on the surface of the substrate 221 so as for a longitudinal direction thereof to be perpendicular to the long axis direction of the first case body 211, an inductor section 225 which connects base ends of the first and second loading sections 223 and 224 to the ground connection conductor 222, a feed section 226 which feeds a current to a connection point P of the first and second loading sections 223 and 224 and the inductor section 225, and a feed conductor 227 which is branched from the inductor section 225 and electrically connects the connection point P to the feed section 226.

The substrate 221 has a substantially L-shaped construction including a first substrate portion 221*a* extending in one direction and a second substrate portion 221*b* curved from the first substrate portion 221*a* and extending in a lateral direction and is made of an insulating material such as a PCB resin. In addition, on a rear surface of the substrate 221, there are provided a control circuit connection port 28 which is connected to a radio frequency circuit of the communication control circuit 203 and a ground connection port 229 which is connected to a ground of the communication control circuit 203.

In addition, the control circuit connection port 228 is connected to the feed section 226 via a through-hole formed on the substrate 221. In addition, the ground connection port 229 is connected to the ground connection conductor 222 via a through-hole.

The first loading section 223 includes a first loading element 231, lands 232A and 232B which are disposed on a surface of the first substrate portion 221*a* to be used to mount the first loading element 231 on the first substrate portion 221*a*, a connection conductor 233 which connects the land 232A to the connection point P, and a lumped element circuit 234 which is formed on the connection conductor 233 and connects a division portion (not shown) for dividing the connection conductor 233. In addition, the first loading section 223 is arranged to be received in the antenna receiving portion 211*a*.

Figure 35:
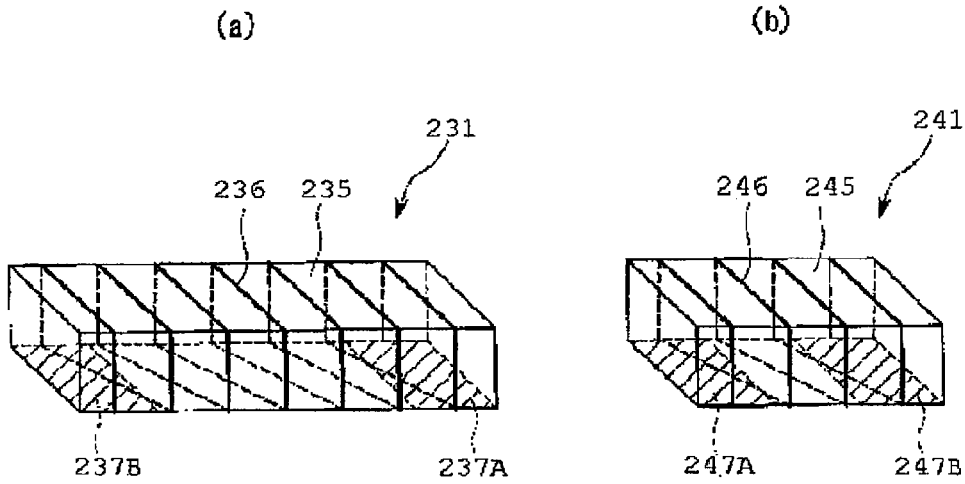
FIG. 35 shows loading devices in FIG. 34, (*a*) is a perspective view of a first loading device, and (b) is a perspective view of a second loading device.

As shown in FIG. 35 (*b*), the first loading element 231 is constructed with a body 235 made of a dielectric material such as alumina and a line-shaped conductor pattern 236 wound around a surface of the body 235 in a longitudinal direction thereof in a helical shape.

Both ends of the conductor pattern 236 are connected to connection conductors 237A and 237B disposed on a rear surface of the body 235, respectively, so as to be connected to the lands 232A and 232B.

The lumped element circuit 234 is constructed with, for example, a chip inductor.

In addition, similar to the first loading section 223, the second loading section 224 is disposed on the second substrate portion 221*b* and includes a second loading element 241, lands 242A and 242B, a connection conductor 243, and a lumped element circuit 244. In addition, the second loading section 224 is constructed to be disposed along an inner surface wall of one side wall of the first case body 211.

In addition, similar to the first loading element 231, as shown in FIG. 35 (*b*), the second loading element 241 is constructed with a body 245 and a conductor pattern 246 wound around a surface of the body 245.

In addition, both ends of the conductor pattern 246 are connected to connection conductors 247A and 247B formed on a rear surface of the body 245 so as to be connected to the lands 242A and 242B.

The inductor section 225 includes an L-shaped pattern 251 which connects the connection point P to the ground connection conductor 222 and a chip inductor 252 which is disposed to be closer to the ground connection conductor 222 than a branch point of the feed conductor 227 of the L-shaped pattern 251 and connects a division portion (not shown) for division the L-shaped pattern 251.

In addition, the feed conductor 227 has a straight line shape pattern for connecting the L-shaped pattern 251 to the feed section 226 connected to the communication control circuit 203.

Figure 36:
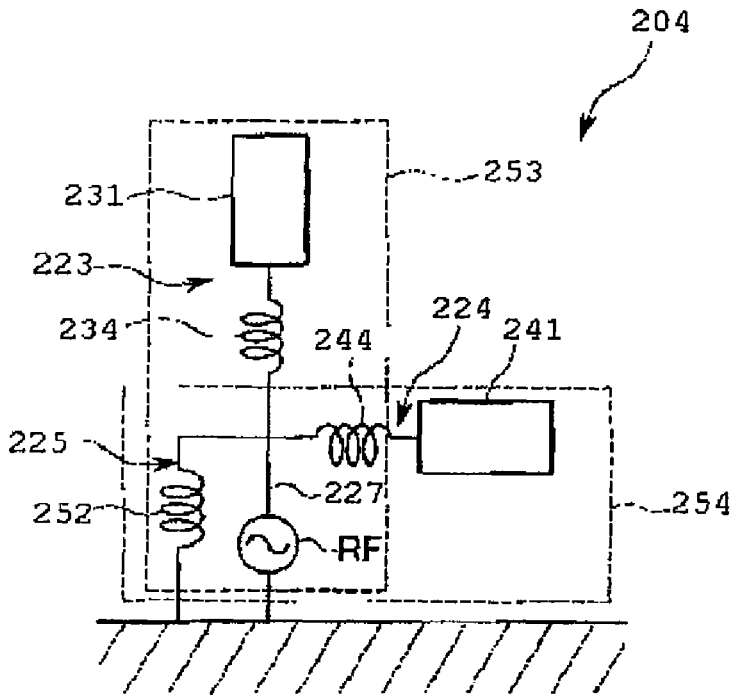
FIG. 36 is a schematic view showing the antenna device in FIG. 34.

As shown in FIG. 36, in the antenna device 204, a first antenna device 253 is constructed with the first loading section 223, the inductor section 225, and the feed conductor 227, and a second antenna device 254 is constructed with the second loading section 224, the inductor section 225, and the feed conductor 227. In addition, in FIG. 36, RF denotes a radio frequency circuit provided to the communication control circuit 203.

The first antenna device 253 is constructed to have a first resonance frequency by adjusting an electrical length thereof using a length of the conductor pattern 236, or an inductance of the lumped element circuit 234, or an inductance of the chip inductor 252.

In addition, similar to the first resonance frequency, the second antenna device 254 is constructed to have a second resonance frequency by adjusting an electrical length thereof using a length of the conductor pattern 246, an inductance of the lumped element circuit 244, and an inductance of the chip inductor 252.

In addition, the first and second loading sections 223 and 224 are constructed to have physical lengths to be shorter than ¼ of antenna operating wavelengths of the first and second antenna devices 253 and 254. By doing so, self resonance frequencies of the first and second loading sections 223 and 224 are higher than first and second resonance frequencies, that is, the antenna operating frequencies of the antenna device 204. Therefore, in terms of the first and second resonance frequencies, the first and second loading sections 223 and 224 are not considered to perform self resonance, so that a property thereof is different from that of a helical antenna which performs the self resonance with the antenna operating frequency.

In the mobile phone 201 having such as a construction, although the physical length of the antenna element is shorter than ¼ of the antenna operating wavelength, the electrical length becomes ¼ of the antenna operating wavelength due to a combination of the loading sections and the inductor section 225. Therefore, in terms of the physical length, the antenna device can be miniaturized greatly.

In addition, since the first loading section 223 is disposed in an inner portion of the antenna receiving portion 211*a* and the second loading section 224 is disposed along an inner surface side of one side wall of the first case body 211, a space occupied by the antenna device 204 can be lowered, so that a space factor becomes better.

In addition, since the first loading section 223 is received in the antenna receiving portion 211*a* formed to protrude from the first case body 211, it is possible to improve transmission and reception characteristics of the first antenna device 253.

In addition, due to the lumped element circuits 234 and 244 provided to the first and second loading sections 223 and 224, it is possible to set the first and second resonance frequencies without adjusting lengths of the conductor patterns 236 and 246. Therefore, it is possible to easily set the first and second resonance frequencies without changing a size of ground of the substrate 221.

First Example

Next, first to fourth examples of an antenna device according to the present invention are described in detail.

Figure 37:
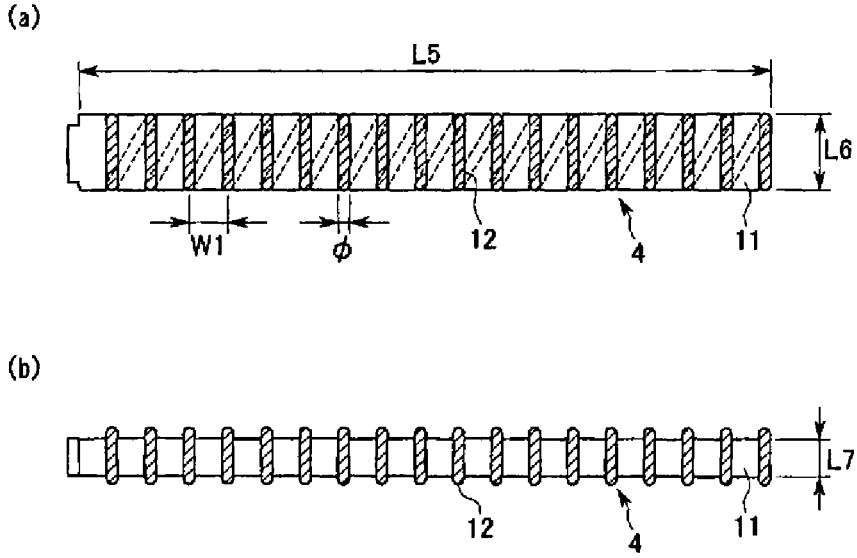
FIG. 37 shows a loading section according to a first example of the present invention, (a) is a plan view thereof, and (b) is a front view thereof.

As a first example, the antenna device 1 according to the first embodiment had been manufactured. As shown in FIG. 37, in the antenna device 1, the loading section 4 was made of alumina, and a copper line having a diameter ϕ of 0.2 mm as the conductor pattern 12 had been wound around a surface of the rectangular parallelepiped body 11 having a length L5 of 27 mm, a width L6 of 3.0 mm, and a thickness L7 of 1.6 mm in a helical shape with a central interval W1 of 1.5 mm.

Second Example

In addition, as a second example, the antenna device 50 according to the second embodiment had been manufactured.

Figure 38:
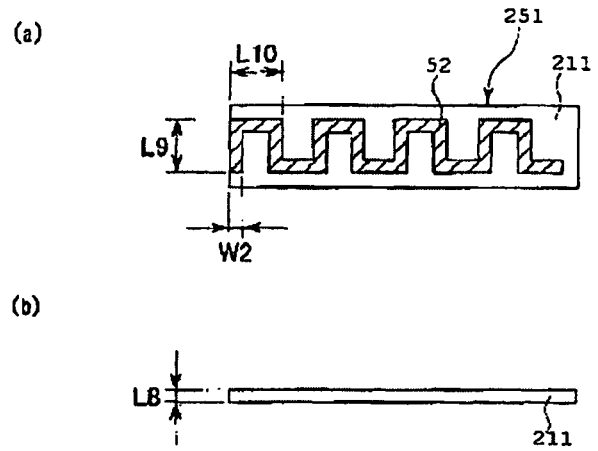
FIG. 38 shows a loading section according to a second example of the present invention, (a) is a plan view thereof, and (b) is a front view thereof.

As shown in FIG. 38, in the antenna device 50, the loading section 51 was made of alumina, and the conductor pattern 52 made of silver having a width W2 of 0.2 mm had been formed on a surface of the rectangular parallelepiped body 11 having a thickness L8 of 1.0 mm in the so as for a length L9 of the body 11 in the width direction thereof to be 4 mm, a length L10 of the body 11 in the longitudinal direction thereof to be 4 mm, and a period to be 12 mm in a meander shape.

Figure 39:
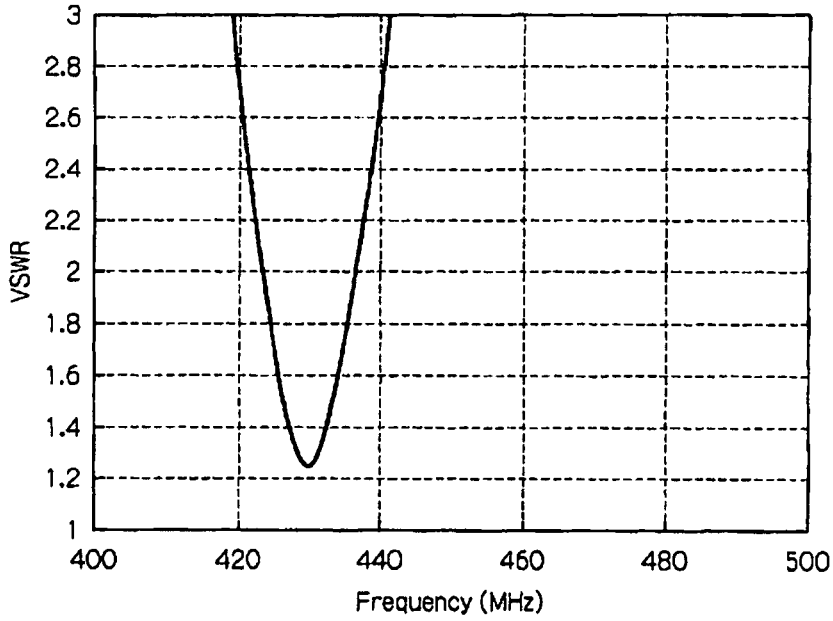
FIG. 39 is a graph showing a VSWR frequency characteristic of the antenna device according to the first example of the present invention.
Figure 40:
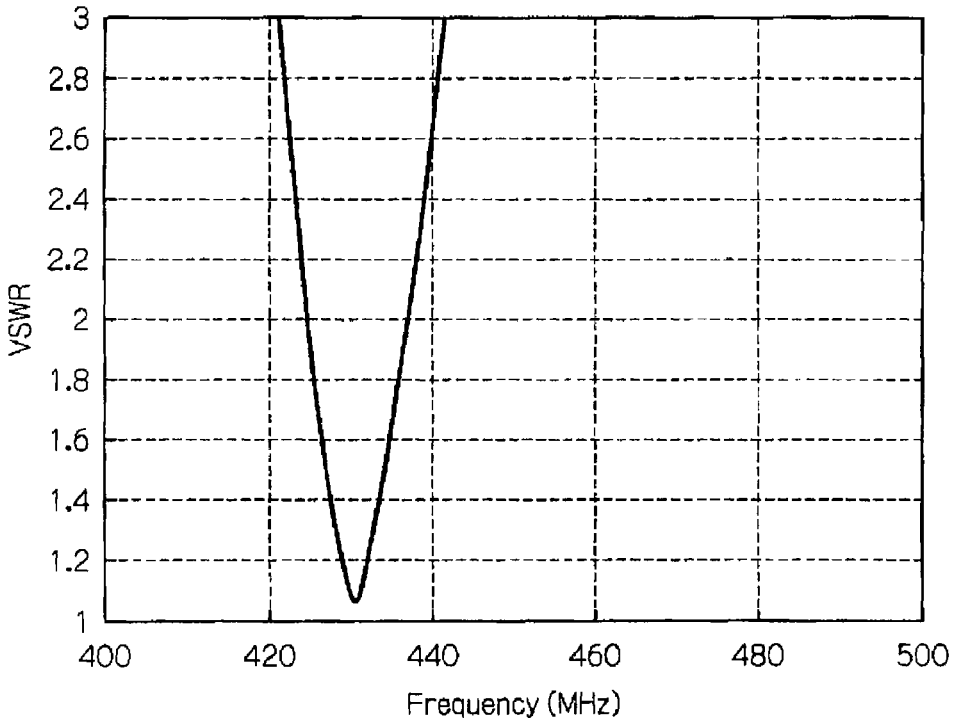
FIG. 40 is a graph showing a VSWR frequency characteristic of the antenna device according to the second example of the present invention.

VSWR frequency characteristics of the antenna device 1 and the antenna device 50 at a frequency of from 400 to 500 MHz are shown in FIGS. 39 and 40.

As shown in FIG. 39, the antenna device 1 had a VSWR of 1.233 at a frequency of 430 MHz and a bandwidth of 18.53 MHz at a VSWR of 2.5.

In addition, as shown in FIG. 40, the antenna device 50 had a VSWR of 1.064 at a frequency of 430 MHz and a bandwidth of 16.62 MHz at a VSWR of 2.5.

As a result, it can be understood that the antenna device could be miniaturized even in a relatively low frequency region such as a band of 400 MHz.

Third Example

Next, as a third example, the antenna device 70 according to the fifth embodiment had been manufactured, and as a comparative example, an antenna device having no meander pattern 71 had been manufactured.

Figure 41:
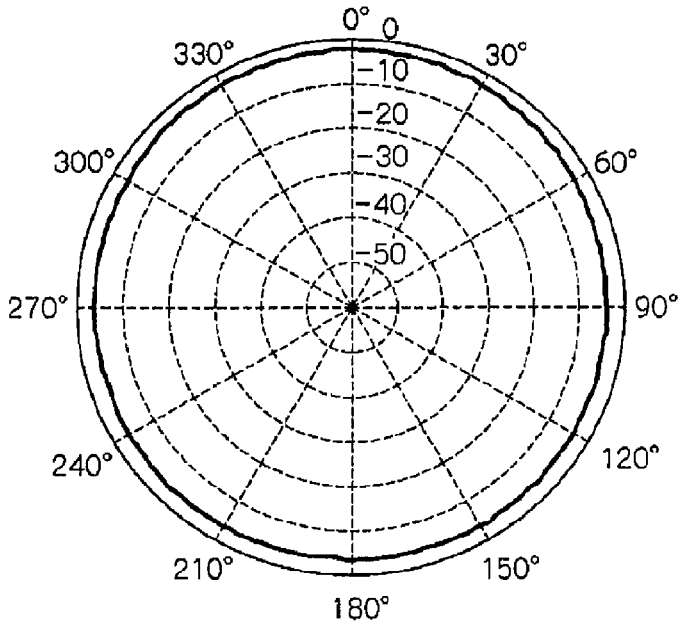
FIG. 41 shows a VSWR frequency characteristic of an antenna device according to the present invention, (a) is a graph for an antenna device according to a third example, and (b) is graph for an antenna according to a comparative example.
Figure 41:
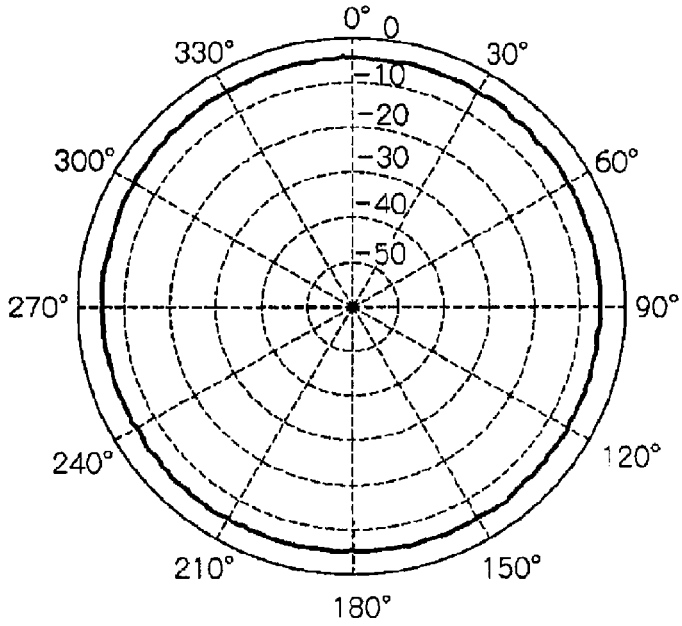

VSWR frequency characteristics of the antenna devices of the third example and the comparative example at a frequency of from 800 to 950 MHz are shown in FIG. 41 (*a*) and (*b*).

Figure 42:
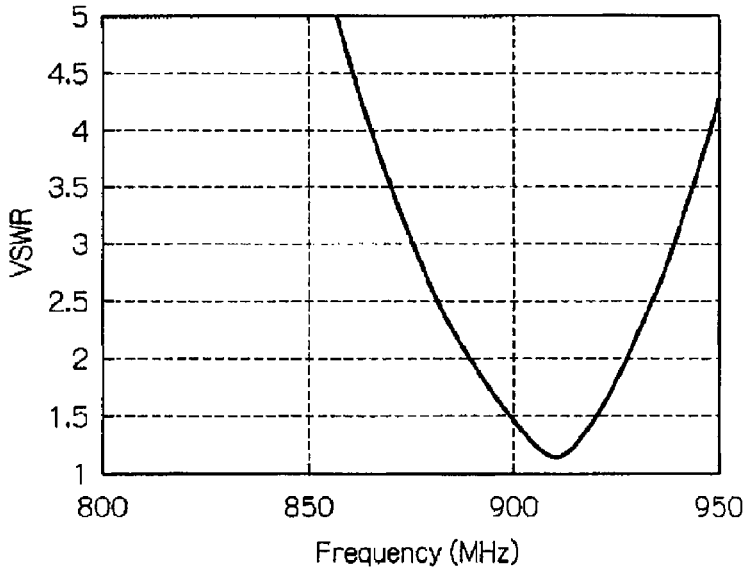
FIG. 42 shows a radiation pattern of a vertical deviating wave of an antenna device according to the present invention, (a) is a graph for an antenna device according to the third example, and (b) is graph for an antenna according to an comparative example.
Figure 42:
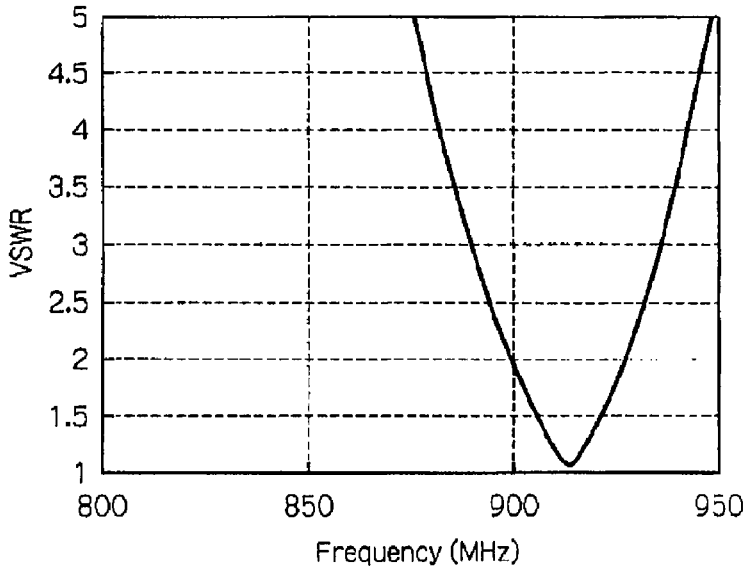

Radiation patterns of the vertical polarization waves of the antenna devices of the third example and the comparative example are shown in FIG. 42 (*a*) and (*b*).

As shown in FIGS. 41 (*a*) and 42 (*a*), in the antenna device 70, a bandwidth at a VSWR of 2.0 became 38.24 MHz, and in the radiation pattern of the vertical polarization waves, a maximum value of gain became −2.43 dBd, a minimum value thereof became −4.11 dBd, and an average value thereof became −3.45 dBd.

As shown in FIGS. 41 (*b*) and 42 (*b*), in the antenna device of the comparative example, a bandwidth at a VSWR of 2.0 became 27.83 MHz, and in the radiation pattern of the vertical polarization waves, a maximum value of gain became −4.32 dBd, a minimum value thereof became −5.7 dBd, and an average value thereof became −5.16 dBd.

As a result, it could be understood that it was possible to obtain an antenna device having a wide band or a high gain by providing the meander pattern 71.

Fourth Example

Next, a fourth example of a communication apparatus according to the present invention is described in detail.

As the fourth example, the mobile phone 201 according to the twelfth embodiment had been manufactured, and a VSWR (Voltage Standing Wave Ratio) frequency characteristic at a frequency of from 800 to 950 MHz had been measured. The result is shown in FIG. 43.

Figure 43:
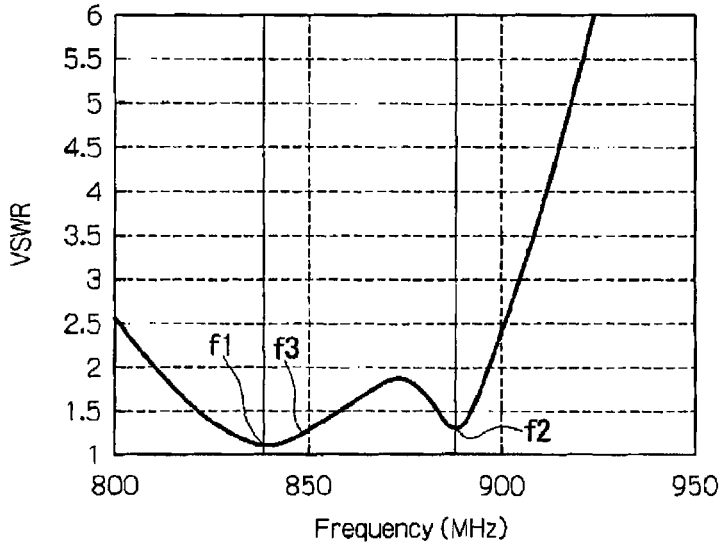
FIG. 43 is a graph showing a relation between a frequency and a VSWR of a mobile phone according to a fourth example of the present invention.

As shown in FIG. 43, the first antenna device 53 represents the first resonance frequency f1, and the second antenna device 54 represents the second resonance frequency f2 which is higher than the first resonance frequency. Here, a VSWR at a frequency of 848.37 MHz (a frequency f3 shown in FIG. 43) in the vicinity of the first resonance frequency f1 became 1.24.

Next, in the mobile phone 201 at a frequency of 848.37 MHz, a directionality of the radiation pattern of the vertical polarization wave in the XY plane shown in FIG. 43 and a directionality of the radiation pattern in the YZ plane of the horizontal wave had been measured. The result is shown in FIG. 44.

Figure 44:
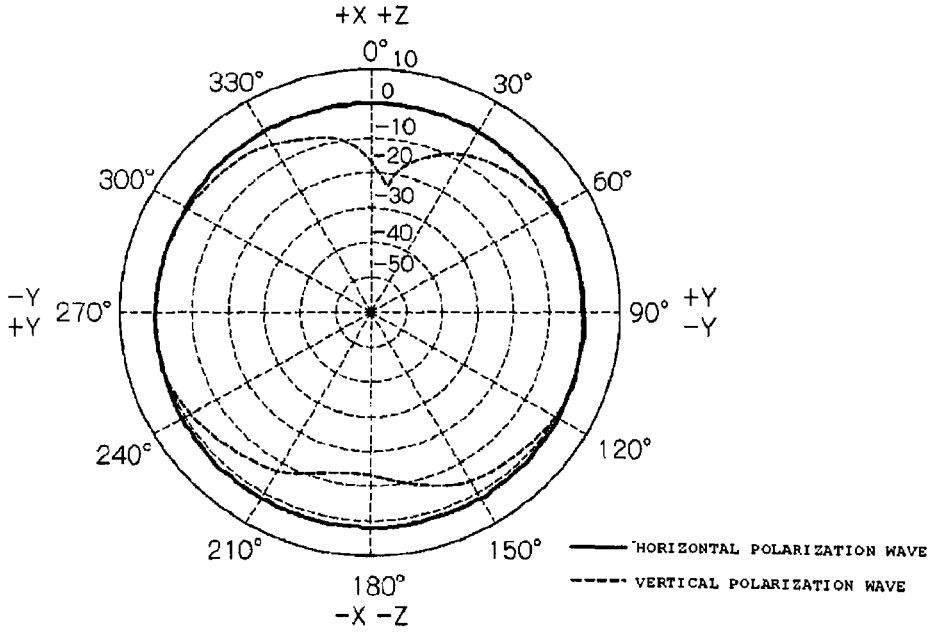
FIG. 44 is a graph showing a directionality of the mobile phone according to the fourth example of the present invention.

As shown in FIG. 44, in the vertical polarization wave, a maximum value became 1.21 dBd, a minimum value became 0.61 dBd, and an average value became 0.86 dBd, and in the horizontal polarization wave, a maximum value became 1.17 dBd, a minimum value became −22.21 dBd, and an average value became −2.16 dBd.

Figure 45:
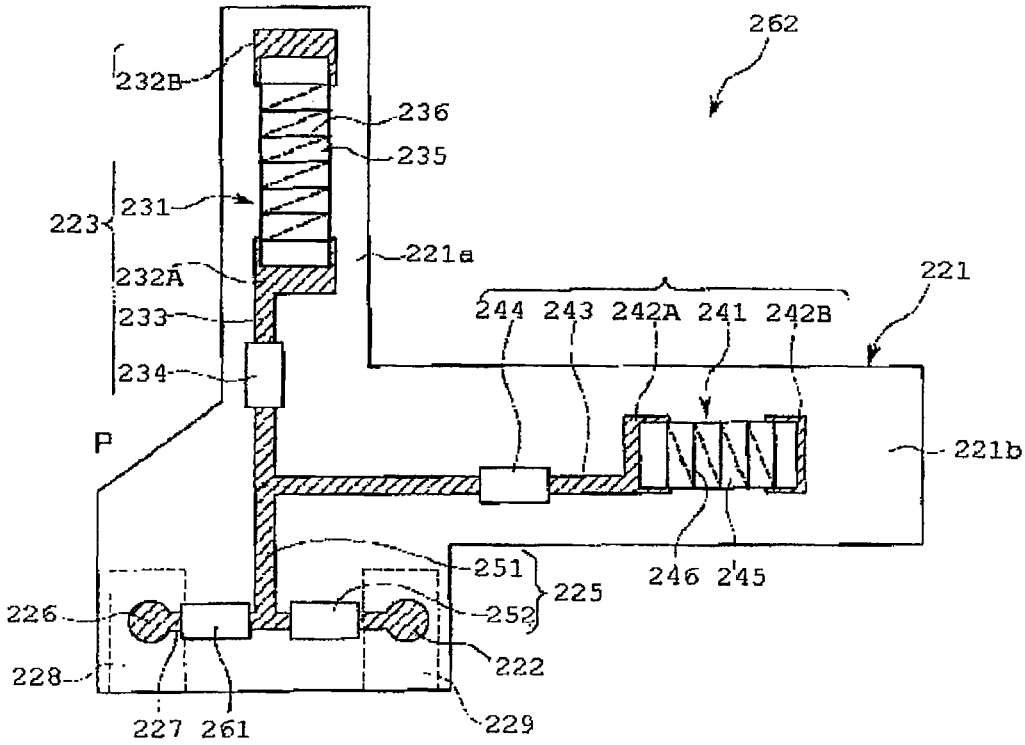
FIG. 45 is a plan view showing an antenna device according to other embodiment of the present invention.

In addition, as shown in FIG. 45, for example, an antenna device 262 may be constructed by forming a division portion (not shown) at the feed conductor 27 and providing a chip capacitor (impedance adjusting section) 261 for connecting the division portion. Here, it is possible to easily match the impedance at the feed section 226 by changing a capacitance of the chip capacitor 261. In addition, the impedance adjusting section is not limited to the chip capacitor, but an inductor may be used.

The present invention is not limited to the aforementioned embodiments, but various modifications may be made within a scope of the present invention without departing from a spirit of the present invention.

For example, although the antenna operating frequency is set to 430 MHz in the aforementioned embodiments, the frequency is not limited thereto, but other antenna operating frequencies may be used.

In addition, although the antenna device according to the embodiment has a helical shape where the conductor pattern is wound around a surface of the body, it may have a meander shape formed on a surface of the body.

In addition, the conductor pattern is not limited to the helical shape or the meander shape, but other shapes may be used.

In addition, although a chip capacitor is used as an impedance adjusting section, any members for adjusting impedance at the feed section may be used, and for example, a chip inductor may be used.

In addition, although a dielectric material such as alumina is used for the body, a magnetic material or a complex material having dielectric and magnetic properties may be used.

INDUSTRIAL APPLICABILITY

In an antenna device according to the present invention, although a physical length of an antenna element parallel to an edge side of a conductor film is shorter than ¼ of an antenna operating wavelength, it is possible to obtain an electrical length which is ¼ of the antenna operating wavelength due to a combination of a loading section and an inductor section. Therefore, in terms of the physical length, the antenna device can be miniaturized greatly. As a result, since the antenna device can be miniaturized, even in a relatively low frequency band such as 400 MHz band, the present invention can be applied to a built-in antenna device for a practical radio apparatus.

In addition, it is possible to easily set the first and second resonance frequencies by adjusting an inductance of an inductor section.

In addition, in a communication apparatus according to the present invention, since the one of two loading sections is received in an antenna receiving portion and the other is disposed along an inner surface side of one side wall of a case body, a space factor becomes better without limitation to an arrangement position of a communication control circuit.

The invention claimed is:

1. An antenna device comprising:

a substrate;

a conductor film which is disposed on a portion of the substrate;

a loading section disposed on the substrate and constructed with a line-shaped conductor pattern which is formed in a longitudinal direction on a body made of a dielectric material;

an inductor section for adjusting the antenna operating frequency, which connects one end of the conductor pattern to the conducive film; and a feed point disposed on the substrate, which feeds a current to a connection point of the one end of the conductor pattern to the conductor film, wherein a longitudinal direction of the loading section is arranged to be parallel to an edge side of the conductor film, a self resonance frequency of the loading section is higher than the antenna operating frequency, and the other end of the line-shaped conductor pattern is formed as an open end.

2. The antenna device according to claim 1, wherein a capacitor section is connected between the connection point and the feed section.

3. The antenna device according to claim 1, wherein the loading section includes a lumped element circuit.

4. The antenna device according to claim 1, wherein the capacitor section includes a capacitor section which is constructed with a pair of planar electrodes formed on the body to face each other.

5. The antenna device according to claim 4, wherein one of a pair of the planar electrodes is disposed on a surface of the elementary body and can be trimmed.

6. The antenna device according to claim 1, wherein a multiple-resonance capacitor section is equivalently serially connected between two different points of the conductor pattern.

7. The antenna device according to claim 1, wherein the conductor pattern is wound around the body in a longitudinal direction thereof in a helical shape.

8. The antenna device according to claim 1, wherein the conductor pattern is formed on a surface of the body in a meander shape.

* * * * *